US007992864B2

(12) United States Patent
Shirasaki

(10) Patent No.: US 7,992,864 B2
(45) Date of Patent: Aug. 9, 2011

(54) SHEET PROCESSING DEVICE AND IMAGE FORMING APPARATUS

(75) Inventor: Seiichi Shirasaki, Osaka (JP)

(73) Assignee: Kyocera Mita Corporation (JP)

( * ) Notice: Subject to any disclaimer, the term of this patent is extended or adjusted under 35 U.S.C. 154(b) by 467 days.

(21) Appl. No.: 12/017,714

(22) Filed: Jan. 22, 2008

(65) Prior Publication Data

US 2008/0174062 A1 Jul. 24, 2008

(30) Foreign Application Priority Data

Jan. 22, 2007 (JP) ..... 2007-011119
Jan. 24, 2007 (JP) ..... 2007-013462

(51) Int. Cl.
*B65H 29/34* (2006.01)
*B65H 39/00* (2006.01)

(52) U.S. Cl. ..... 271/189; 270/58.01; 270/58.07

(58) Field of Classification Search ..... 271/3.01, 271/3.02, 3.03, 189; 270/58.01, 58.27
See application file for complete search history.

(56) References Cited

U.S. PATENT DOCUMENTS 4,989,854 A * 2/1991 McNamara ..... 271/213
6,145,825 A * 11/2000 Kunihiro et al. ..... 270/58.09
6,199,853 B1 * 3/2001 Andoh et al. ..... 270/58.14
6,471,429 B1 * 10/2002 Isobe et al. ..... 400/582
6,631,896 B2 * 10/2003 Yamada et al. ..... 270/58.09
6,671,492 B2 * 12/2003 Mimura et al. ..... 399/407
7,487,964 B2 * 2/2009 Suzuki et al. ..... 271/176
7,520,498 B2 * 4/2009 Hattori et al. ..... 270/58.07
7,690,633 B2 * 4/2010 Tamura et al. ..... 270/37
2006/0120784 A1 * 6/2006 Iida et al. ..... 399/407
2007/0138726 A1 * 6/2007 Tamura et al. ..... 270/37
2008/0099974 A1 * 5/2008 Nomura et al. ..... 270/58.12
2008/0174062 A1 * 7/2008 Shirasaki ..... 271/4.06

FOREIGN PATENT DOCUMENTS

JP 10152258 6/1998
JP 2003-128293 5/2003
JP 2003128293 * 5/2003
JP 2004035156 2/2004
JP 2004345748 12/2004
JP 2005-154034 6/2005
JP 2006137571 6/2006
JP 2006315840 11/2006

* cited by examiner

*Primary Examiner* — Kaitlin S Joerger
*Assistant Examiner* — Patrick Cicchino
(74) *Attorney, Agent, or Firm* — Gerald E. Hespos; Michael J. Porco

(57) ABSTRACT

A sheet processor includes a processing tray with a first surface that receives sheets and forms a pile of sheets. An endless belt circulates by way of first and second surface sides on a side opposite the first surface of the processing tray. A first roller reverses a circulation path of the endless belt from the first surface side to the second surface side. A second roller is disposed at an interval from the first roller and reverses the circulation path from the second surface side. First and second abutments are attached to the belt and abut an end edge of the pile of sheets. The abutments are attached to the belt so that the first abutment is positioned near the first roller and on the second surface side and the second abutment is near the second roller on the second surface side.

14 Claims, 18 Drawing Sheets

+Y
+X
-X
-Y
10
11
19
13
41
113
112
111
16
114
32
15
14
40
30
20
V
V1
115
121
34
31
33
17
S1
S2
43
341
343
342
311

-X
+X
P
R1
R3
R4
133
353a
37B
V1
V2
44
42
40
20
30
46
47
48
P1
32
36
352
37A
38

-X
+X
R4
133
R1
P
44
V2
40
20
30
46
47
48
P1
353a
37B
V1
352
37A
38

-X
+X
133
R3
P
44
V2
40
200
230
42
46
47
V1
236
232
2353a
2353c
237B
2371
2372
237A
2353b
2352
P1
2394
2393
2391
38
2372
2371
237A

-X
+X
133
R3
P1
44
394
V2
42
46
47
V1
232
236
237A
2353a
2353c
2353b
2352
237B
2393
2391
38
2371
2372
2394

-X
+X
P
133
R3
44
V3
40
230
200
46
47
2394
38
237B
2371
2372
2353a
P1
236
V1
2353c
2353b
2352
237A
2393
2391

SHEET PROCESSING DEVICE AND IMAGE FORMING APPARATUS

BACKGROUND OF THE INVENTION

1. Field of the Invention

The present invention relates to a sheet processing device that applies specific processing on a sheet and to an image forming apparatus that adopts the sheet processing device as a post-processing device.

2. Description of the Related Art

Post-processing devices as disclosed in JP-A-2003-128293 and JP-A-2005-154034 have been known. These post-processing devices each apply specific post-processing (alignment processing and staple processing) on sheets successively fed therein from the image forming apparatus. These post-processing devices each include a processing tray provided diagonally, an endless belt provided to sandwich the main surface side and the back surface side of the processing tray and having a pair of claw members to move up and down sheets, a stapler that applies staple processing on a pile of sheets stacked on the processing tray and supported on the claw member, and so forth.

A pile of sheets is formed as a specific number of sheets are discharged successively onto the processing tray from the image forming apparatus and received by one of the claw members. This pile of sheets is moved to the position of the stapler by the circulation of the endless belt and the staple processing is applied to the pile of sheets at the moved position. The pile of sheets after the completion of the staple processing is moved up along the processing tray with the movement of the claw member by the circulation of the belt and discharged to the outside. One of the claw members after the pile of sheets is discharged comes around toward the back surface of the processing tray with the circulation of the endless belt. Meanwhile, the other claw member moves toward the main surface and stands by for the feeding of a sheet for the next job onto the processing tray.

JP-A-2005-154034 supra describes that the claw members are allowed to function as alignment means (line-up means) for a pile of sheets in the transportation direction thereof. This patent document, however, merely discloses that two claw members functioning as the alignment means are simply provided to the endless belt, and improvement in efficiency of the alignment processing on a pile of sheets, avoidance of interference with a pile of sheets to be discharged onto the processing tray, and so forth are not fully taken into account.

SUMMARY OF THE INVENTION

An object of the invention is to shorten a sheet processing time required for a pile of sheets by ensuring smooth transportation of the pile of sheets in a sheet processing device or in a post-processing device attached to an image forming apparatus.

A sheet processing device according to one aspect of the invention that achieves the above and other objects is a sheet processing device that applies specific processing on a pile of sheets, including: a processing tray that is provided with a first surface to receive sheets successively fed therein and forms the pile of sheets in a stacked state; an endless belt that circulates by way of a first surface side and a second surface side on a side opposite to the first surface of the processing tray; plural rollers over which the endless belt is stretched; and a first abutting member and a second abutting member that are attached to the endless belt and allowed to abut on an end edge portion of the pile of sheets. The plural rollers include a first roller that reverses a circulation path of the endless belt from the first surface side to the second surface side, and a second roller that is disposed at a specific interval from the first roller and reverses the circulation path from the second surface side to the first surface side. The first abutting member and the second abutting member are attached to the endless belt so as to form a state where the first abutting member is positioned in the vicinity of the first roller and on the second surface side and the second abutting member is positioned in the vicinity of the second roller and on the second surface side.

Also, an image forming apparatus according to another aspect of the invention includes an apparatus main body that applies image forming processing on a sheet and a post-processing device that receives the sheet after completion of the image forming processing from the apparatus main body and applies specific post-processing on a pile of sheets made up of sheets that have been received and stacked. The post-processing device is of the configuration of the sheet processing device described above.

DETAILED DESCRIPTION OF THE PREFERRED EMBODIMENTS

Hereinafter, embodiments of the invention will be described in detail on the basis of the drawings.

First Embodiment

Figures 1A, 1B, 1C:
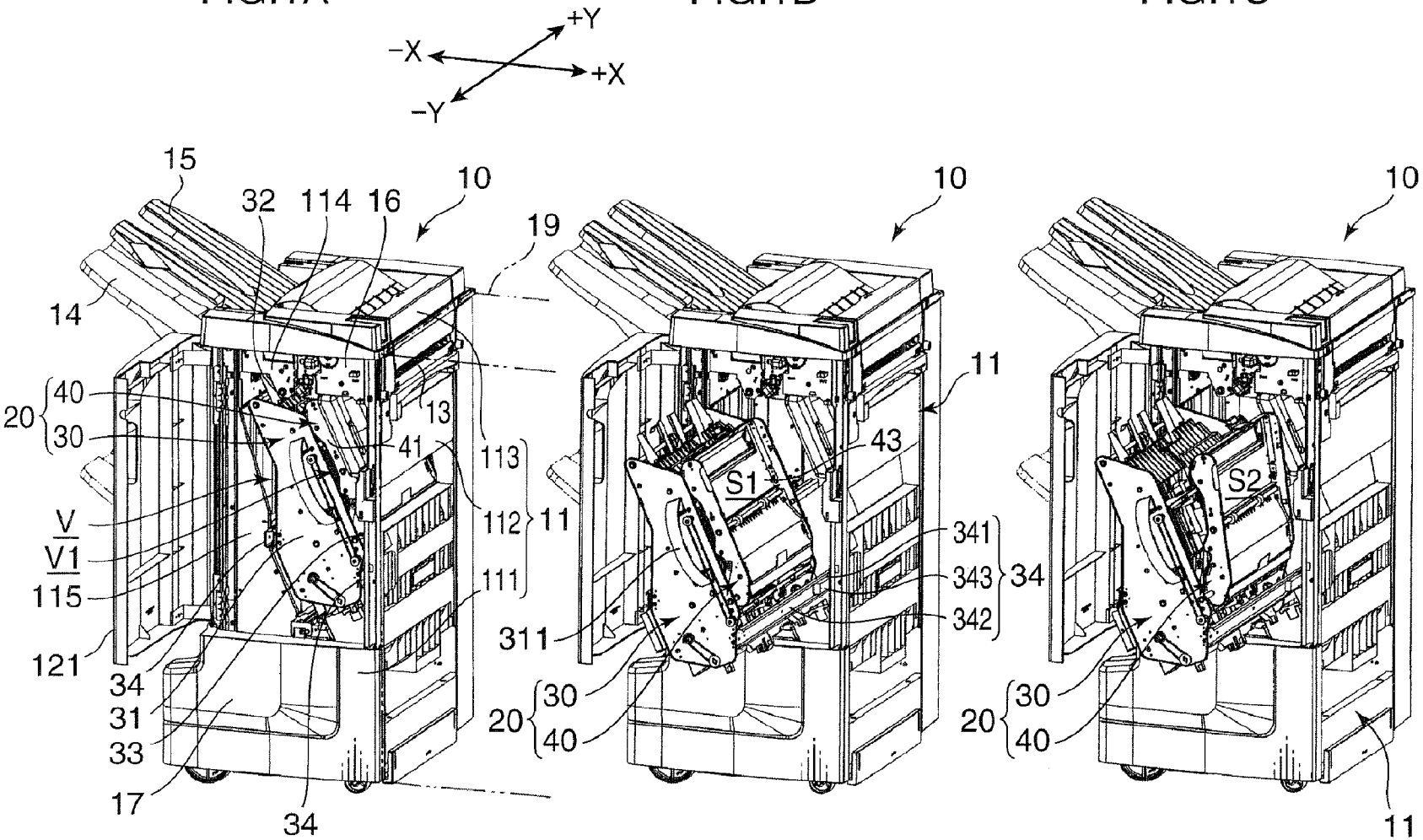
FIGS. 1A through 1C are outward perspective views of a post-processing device according to a first embodiment of the invention, FIG. 1A showing a state where a processing unit is accommodated in a housing, FIG. 1B showing a state where the processing unit is pulled out from the housing, and FIG. 1C showing a state where a detour tray of the processing unit pulled out from the housing is open.

Firstly, the outward appearance of a post-processing device 10 (sheet processing device) according to a first embodiment of the invention will be described. FIGS. 1A through 1C are outward perspective views of the post-processing device according to the first embodiment of the invention. FIG. 1A shows a state where a processing unit 20 is accommodated in a housing 11. FIG. 1B shows a state where the processing unit 20 is pulled out from the housing 11. FIG. 1C shows a state where a detour tray 40 in the processing unit 20 pulled out from the housing 11 is open. In FIGS. 1A through 1C and other drawings referred to below, an X-X direction is defined as the right-left direction, a Y-Y direction is defined as the front-back direction. In particular, a −X direction is defined as leftward, a +X direction as rightward, a −Y direction as frontward, and a +Y direction as backward.

As is shown in FIG. 1, the post-processing device 10 is annexed to an image forming apparatus 19 (apparatus main body) and receives a sheet after the completion of the image forming processing to apply specific post-processing (sheet processing) on this sheet or a pile of sheets made up of stacked sheets. The image forming apparatus 19 applies image forming processing on a sheet and includes an image forming unit to transfer a toner image onto a sheet and having components, such as a photoconductive drum, a charging device, an exposing device, a developing device, and a transfer device, a fixing unit to fix the toner image onto the sheet, a sheet transportation unit, and so forth.

The post-processing device 10 is formed by installing members for post-processing of various kinds to apply post-processing on sheets P inside the housing 11 having a box shape when viewed from the outside. The housing 11 includes a front plate 111 provided to erect from the front edge portion of an unillustrated bottom plate, a right side plate member 112 provided to erect from the right edge portion of the bottom plate, an unillustrated back surface plate provided to erect from the rear edge portion of the bottom plate, an unillustrated left side plate provided to erect from the left edge portion of the bottom plate, and a top plate member 113 provided to cover the top edge portions of the front plate 111, the right side plate member 112, the left side plate, and the back surface plate, and is thereby formed in the shape of a rectangular prism.

The front plate 111 is set in such a manner that a height dimension from the bottom plate is about ⅓ of a height dimension of the post-processing device 10. An accommodation space V to accommodate therein the processing unit 20 that applies post-processing, such as staple processing, stacking, alignment, and shifting, on sheets P, and a front door 121 to close this accommodation space V are provided above the front plate 111. Incidentally, FIG. 1A through FIG. 1C each show a state where the front door 121 is open.

A sheet receiving opening 13 to receive a sheet P (see FIG. 2) fed from the image forming apparatus 19 is provided above the right side plate member 112. Post-processing, such as punching processing to punch out binding holes and staple processing to bind a pile of sheets, P1 (see FIG. 2), is applied on sheets P introduced into the post-processing device 10 via the sheet receiving opening 13.

A main tray 14 is provided on the left side surface of the post-processing device 10 and a sub-tray 15 is also provided to the left side portion of the top plate member 113. The main tray 14 receives a pile of sheets, P1, after the completion of the staple processing. The main tray 14 is formed so that it is allowed to move up or down by the driving of specific elevator means, and is moved down step by step from the uppermost position with an increment of the number of piles of sheets, P1, being discharged. On the contrary, the sub-tray 15 receives sheets that are discharged without application of post-processing in the post-processing device 10 or sheets onto which is applied only the punching processing to punch out binding holes.

A punch unit 16 to punch out binding holes in a sheet P immediately after it is fed into the housing 11 from the image forming apparatus 19 by passing through the sheet receiving opening 13 is provided at the upper right inside the housing 11. An upper frame plate 114 that supports various rollers is provided on the left side of the punch unit 16 so as to face the front opening of the accommodation space V. A triangular frame plate 115 almost in a triangular shape is provided below the upper frame plate 114 and on the left side in the post-processing device 10 so as to face the front opening of the accommodation space V. The triangular frame plate 115 is formed in such a manner that the right edge portion thereof inclines right downward from the upper left inside the post-processing device 10.

The processing unit 20 is provided at the right position of the triangular frame plate 115 below the upper frame plate 114. The processing unit 20 temporarily stores a specific number of sheets P fed therein from the image forming apparatus 19, and applies the staple processing on a pile of stacked sheets, P1, using binding staples. A center folding unit 17 for so-called center folding processing is provided at a position below the processing unit 20. The center folding unit 17 applies the staple processing on a pile of sheets, P1, made up of sheets P that have passed by the processing unit 20 without being subjected to the staple processing, at the center position in the transportation direction and then applies folding processing along the center position.

The processing unit 20 includes a staple tray 30 provided diagonally immediately on the right side of the triangular frame plate 115, and the detour tray 40 additionally provided to the staple tray 30 along the diagonal surface on the right side in a rotatable manner with respect to the staple tray 30.

The staple tray 30 includes a pair of first frame plates 31 provided in the front-back direction and an intermediate tray main body 32 (processing tray; see FIG. 2) provided diagonally across a space between a pair of these first frame plates 31. Meanwhile, the detour tray 40 includes a pair of second frame plates 41 provided in the front-back direction and a detour tray main body 42 (see FIG. 2) provided in parallel with the intermediate tray main body 32 across a space between a pair of these second frame plates 41.

A coupling shaft 33 provided across a space between a pair of the first frame plates 31 is provided at the right bottom portion of the staple tray 30. The detour tray 40 is allowed to rotate forward and backward about the coupling shaft 33 as the bottom end portions of a pair of the second frame plates 41 are through-coupled to the coupling shaft 33. The detour tray main body 42 is allowed to change its posture between a closing posture S1 shown in FIG. 1B to close the intermediate tray main body 32 and an opening posture S2 shown in FIG. 1C to open the intermediate tray main body 32.

A post-processing space V1 having a specific spacing dimension for storing sheets P is defined between the intermediate tray main body 32 and the detour tray main body 42. The staple processing is applied on a pile of sheets, P1, formed as a specific number of sheets P are successively fed into the post-processing space V1.

In the event of sheet jamming in the post-processing space V1 in the processing unit 20, the processing unit 20 is pulled out from the accommodation space V in the post-processing device 10 manually by the operator (FIG. 1B). In this state, the operator changes the posture of the detour tray 40 from the closing posture S1 (FIG. 1B) to the opening posture S2 (FIG. 1C), so that a jammed sheet P is exposed to the outside. Accordingly, the operator can remove the jammed sheet P with ease.

The processing unit 20 is inserted into or removed from the accommodation space V in the post-processing device 10 as it is guided by a pair of guide members 34 provided on the right and on the left slightly below the center of the staple tray 30 in the top-bottom direction. The guide members 34 each include a stationary rail 341 fixed to the inner surface of the right side plate member 112 and the left side plate member of the housing 11 to extend in the front-back direction, a movable rail 342 fixed to the staple tray 30 so as to oppose the stationary rail 341, and a retainer 343 interposed between the stationary rail 341 and the movable rail 342.

According to the guide members 34, when the staple tray 30 is inserted into or removed from the accommodation space V, the movable rail 342 starts to move forward or backward as it is guided by the stationary rail 341 via the retainer 343. This enables the operator to smoothly pull out the staple tray 30 from the accommodation space V or smoothly accommodate it into the accommodation space V.

A handle band 311 made of a flexible material, such as a synthetic resin sheet, is provided at an appropriate position of the first frame plate 31 on the front. By holding the handle band 311 and pulling it forward, the operator becomes able to pull out the processing unit 20 accommodated in the accommodation space V (FIG. 1A) to the outside (FIG. 1B).

Figure 2:
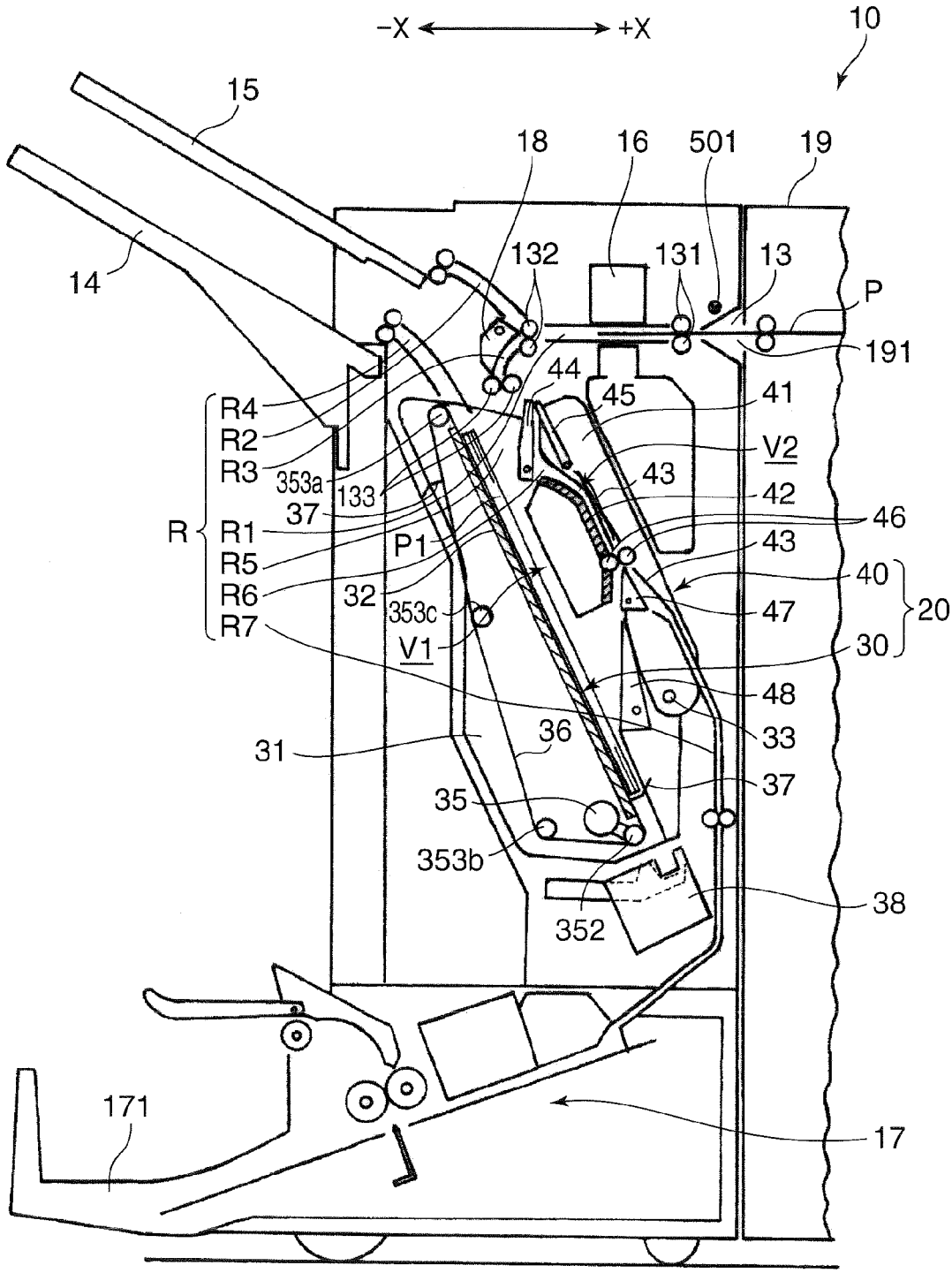
FIG. 2 is an explanatory view of the post-processing device according to the first embodiment when viewed in cross section from the front.

The inner structure of the post-processing device 10 will now be described on the basis of FIG. 2. FIG. 2 is an explanatory view showing the inner structure of the post-processing device 10 according to the first embodiment when viewed in cross section from the front. Indications of directions using a capital X in FIG. 2 are the same as in FIG. 1 (−X: leftward, +X: rightward).

A sheet transportation path R for transporting a sheet P fed from the image forming apparatus 19 to a destination depending on the purpose is formed in the post-processing device 10. The sheet transportation path R is formed of an inlet side transportation path R1, a transportation path R2 headed for sub-tray, a transportation path R3 headed for processing tray, a transportation path R4 headed for main tray, a transportation path R5 headed for staple tray, a transportation path R6 headed for detour tray, and a transportation path R7 headed for center folding unit.

The inlet side transportation path R1 extends leftward from the sheet receiving opening 13 of the post-processing device 10 to almost the center position of the post-processing device 10 in the right-left direction. The transportation path R2 headed for sub-tray branches from the downstream end of the inlet side transportation path R1 and extends toward the sub-tray 15. The transportation path R3 headed for processing tray branches from the downstream end of the inlet side transportation path R1 and extends toward the post-processing space V1 in the processing unit 20. The transportation path R4 headed for main tray extends toward the main tray 14 from the top end of the post-processing space V1. The transportation path R5 headed for staple tray branches leftward from the downstream end of the transportation path R3 headed for processing tray and is headed for the staple tray 30. The transportation path R6 headed for detour tray branches from the downstream end of the transportation path R3 headed for processing tray and is headed rightward. The transportation path R7 headed for center folding unit passes through the detour tray 40 and is headed for the center folding unit 17.

The punch unit 16 is provided at a position above the inlet side transportation path R1. A sheet P introduced into the inlet side transportation path R1 via the sheet receiving opening 13 is suspended, and in this state, binding holes are punched out at appropriate points in the punching processing by the driving of the punch unit 16.

A switching guide 18 that switches the transportation destination of a sheet P between the transportation path R2 headed for sub-tray and the transportation path R3 headed for processing tray is provided at the downstream end of the inlet side transportation path R1. When no post-processing, such as stapling, is to be applied on a sheet P, the sheet P is discharged onto the sub-tray 15 via the transportation path R2 headed for sub-tray by a specific posture setting of the switching guide 18.

Meanwhile, when the post-processing is to be applied, the sheet P is fed into the processing unit 20 via the transportation path R3 headed for processing tray by changing the posture of the switching guide 18. In the processing unit 20, a pile of sheets, P1, is formed as a specific number of sheets P are stored in the post-processing space V1, and staple processing is applied to the pile of sheets, P1. The pile of sheets, P1, after the completion of the staple processing is discharged toward the main tray 14 via the transportation path R4 headed for main tray.

The transportation path R7 headed for center folding unit extends downward from almost the intermediate position of the detour tray 40 in the top-bottom direction. A sheet P subjected to the center folding processing passes above the detour tray main body 42, and is then introduced into the center folding unit 17 by passing through the transportation path R7 headed for center folding unit. The transportation path R7 headed for center folding unit is formed in such a manner that the bottom portion thereof is left downward from the bottom end of the processing unit 20.

A pile of sheets, P1, formed as sheets P are successively introduced into the center folding unit 17 is subjected to specific center folding processing in the center folding unit 17, and then discharged toward a center folding tray 171 formed in the housing 11 at the bottom end portion on the left.

Figure 3:
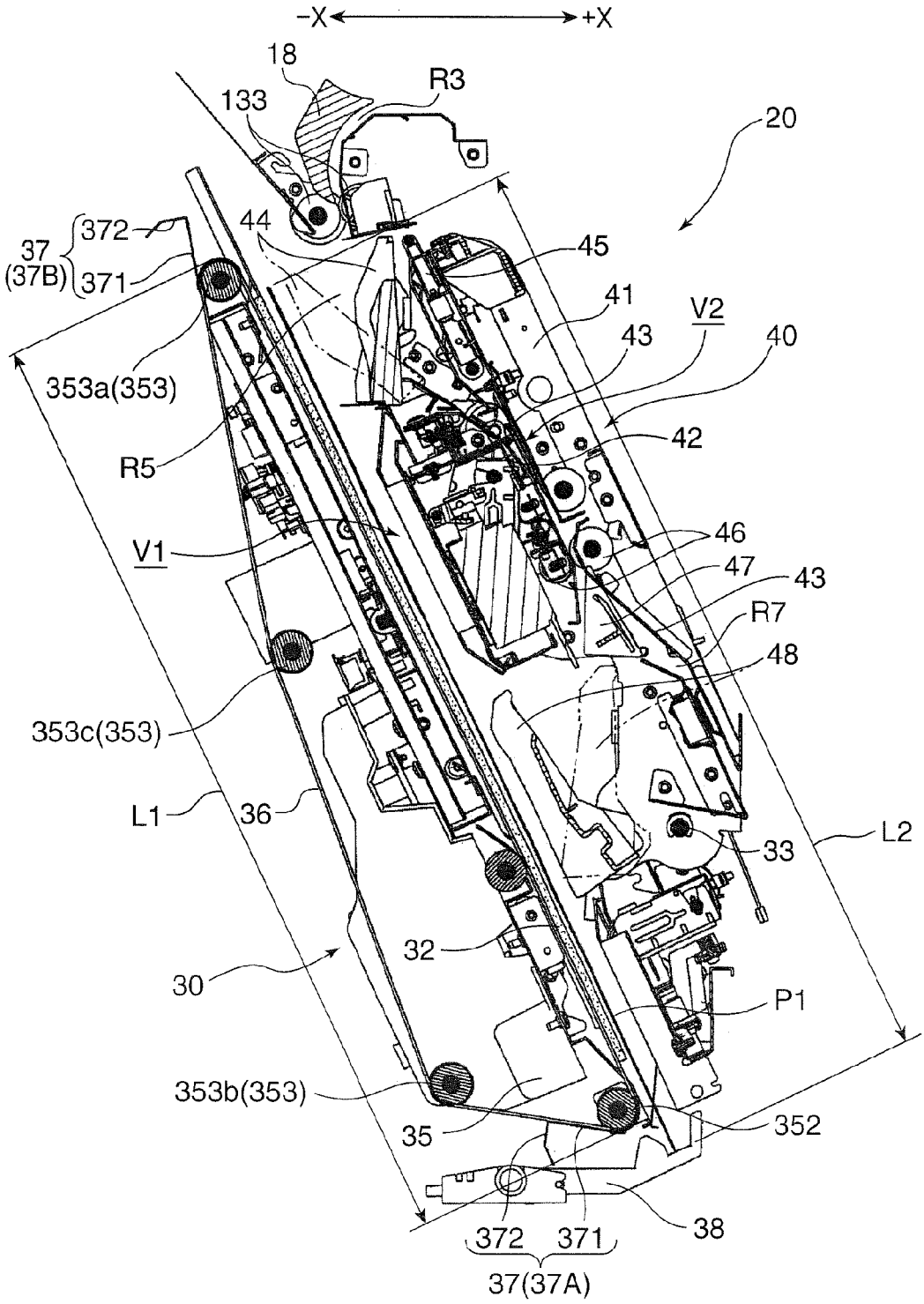
FIG. 3 is an enlarged view showing a part of a staple unit of FIG. 2.

Hereinafter, the structure of the processing unit 20 will be described schematically on the basis of FIG. 3 and with reference to FIG. 1 and FIG. 2 when necessary. FIG. 3 is an enlarged view of the processing unit 20 shown in FIG. 2. FIG.

Figure 4:
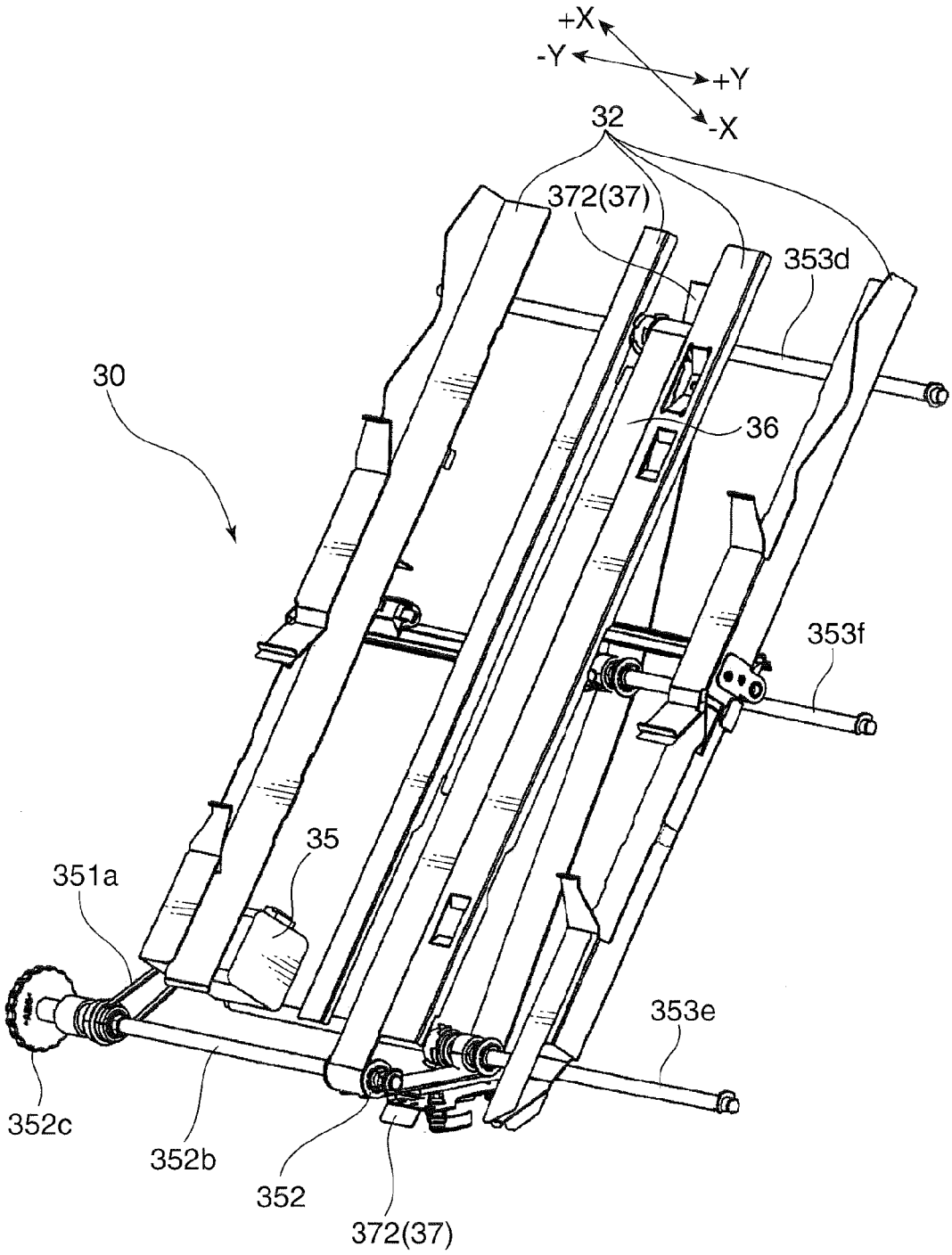
FIG. 4 is a perspective view showing a first example of a staple tray of the first embodiment and it is a view of the staple tray when viewed from the main surface side.
Figure 5:
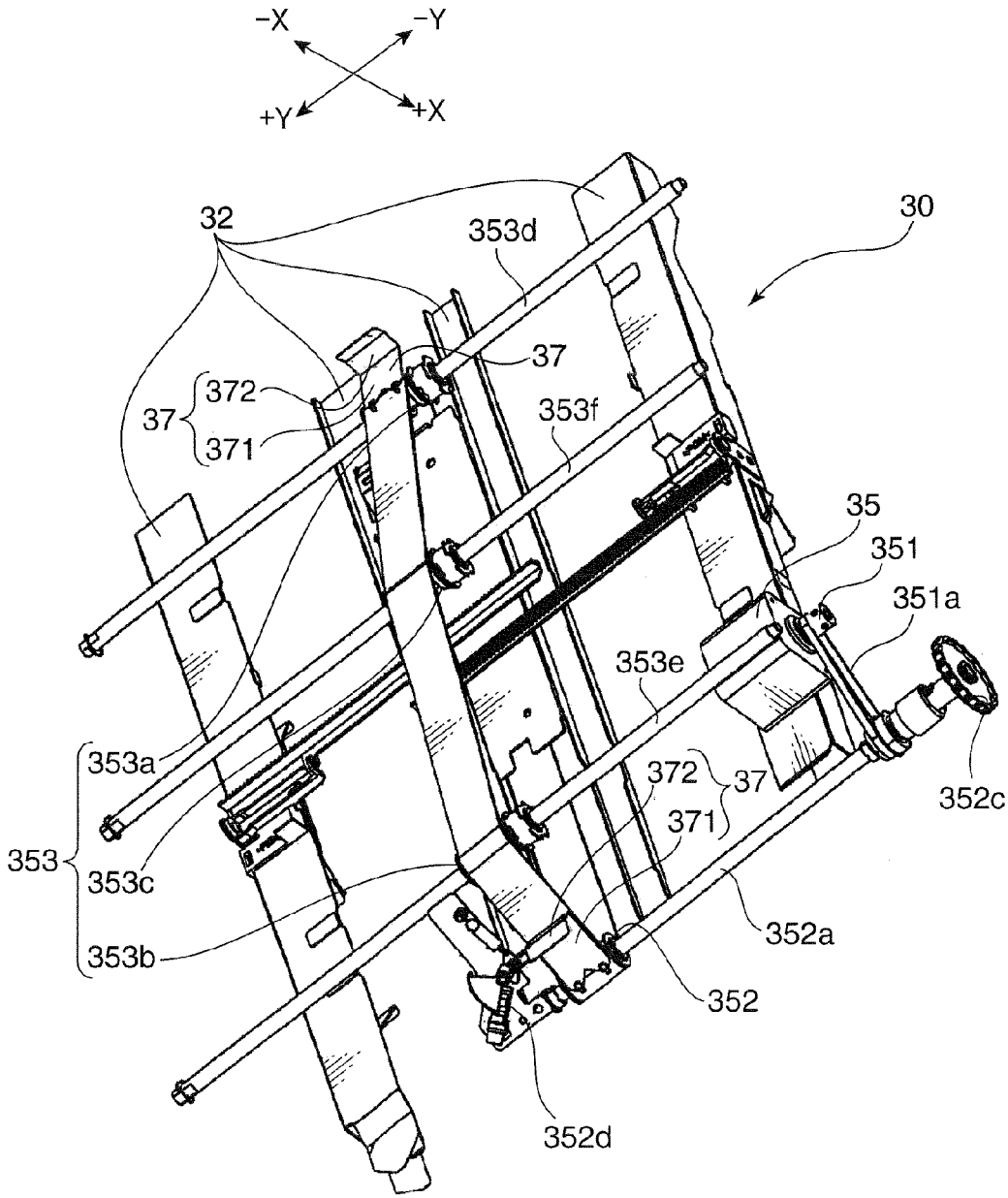
FIG. 5 is a perspective view of the staple tray shown in FIG. 4 when viewed from the back surface side.

4 and FIG. 5 are perspective views showing a first example of the staple tray 30. FIG. 4 is a view of the staple tray 30 when viewed from the main surface side. FIG. 5 is a view of the staple tray 30 when viewed from the back surface side (the surface on the side opposite to the sheet stacking side). Indications of directions using capitals X and Y in FIG. 3 through FIG. 5 are the same as in FIG. 2 (X indicates the right-left direction (−X: leftward, +X: rightward) and Y indicates the front-back direction (−Y: frontward, +Y: backward)).

The intermediate tray main body 32 (processing tray) provided to the staple tray 30 forms a pile of sheets, P1, in which plural sheets P are stacked. The right side of the intermediate tray main body 32 shown in FIG. 3 is the main surface (first surface) and the side of this main surface serves as the sheet stacking surface to receive sheets P successively fed from the image forming apparatus 19.

A belt motor 35 is disposed on the back surface side (the second surface on the side opposite to the first surface) of the intermediate tray main body 32 in a state where the driving shaft 351 thereof is aligned in the front-back direction. The driving rotation of the driving shaft 351 of the belt motor 35 is transmitted to a driving roller 352 (first roller) provided at a specific position below the intermediate tray main body 32 via a coupling belt 351*a*.

As are shown in FIG. 4 and FIG. 5, an operation handle 352*c* is provided to the front end of a roller shaft 352*b* that is coaxial and rotates integrally with the driving roller 352. The operation handle 352*c* is manually rotated, for example, in the event of sheet jamming in the processing unit 20, while the processing unit 20 is pulled out from the housing 11 (see FIG. 1B and FIG. 1C). An elevator endless belt 36 described below is circulated via the driving roller 352 by the rotation of the roller shaft 352*b* about the shaft center thereof. Accordingly, a jammed sheet P is moved and this movement contributes to elimination of sheet jamming.

A sensor 352*d* that detects a first sheet receiving member 37A and a second sheet receiving member 37B (first supporting member and second supporting member, which are collectively referred to simply as the sheet receiving members 37) provided to the elevator endless belt 36 and described below is provided in the vicinity of the driving roller 352. The sensor 352*d* detects whether the first sheet receiving member 37A and the second sheet receiving member 37B are present at the home positions.

Plural driven rollers 353 each in a state where the driven shaft is provided across a space between a pair of the first frame plates 31 are provided at the top end position of the intermediate tray main body 32 and at appropriate points on the back surface side (the surface on the side opposite to the sheet stacking surface) of the intermediate tray main body 32.

In this embodiment, as the driven rollers 353, a top driven roller 353*a* (second roller) provided correspondingly to the top portion side of the intermediate tray main body 32, a bottom driven roller 353*b* provided in the bottom portion of the intermediate tray main body 32 on the back surface side at a position slightly above the driving roller 352, and an intermediate driven roller 353*c* provided at the intermediate position between the top and bottom driven rollers 353*a* and 353*b*.

The top driven roller 353*a* is axially supported so as to be relatively rotatable about a top shaft 353*d* provided across a space between a pair of the first frame plates 31. The bottom driven roller 353*b* is axially supported so as to be relatively rotatable about a bottom shaft 353*e* provided in the same manner as above. The intermediate driven roller 353*c* is axially supported so as to be relatively rotatable about an intermediate shaft 353*f* provided in the same manner as above.

The elevator endless belt 36 is stretched over the driving roller 352 and the driven rollers 353 (plural rollers), and circulates by way of the main surface (first surface) side and the back surface (second surface) side of the intermediate tray main body 32. Herein, the driving roller 352 reverses the circulation path of the endless belt 36 from the main surface side to the back surface side and the top driven roller 353*a* reverses the circulation path of the endless belt 36 from the back surface side to the main surface side.

The elevator endless belt 36 is provided with a pair of the sheet receiving members 37. The sheet receiving members 37 abut on the tip edge portion of a pile of sheets, P1, in the sheet carry-in direction. They receive sheets P fed successively from the image forming apparatus 19 and form a pile of sheets, P1, for one job on the intermediate tray main body 32. This embodiment shows a case where two members, that is, the first sheet receiving member 37A and the second sheet receiving member 37B, are attached to the elevator endless belt 36.

The sheet receiving members 37 each include a flat plate portion 371 firmly fixed to the elevator endless belt 36 and a hook portion 372 formed at the tip end of the flat plate portion 371 to receive a sheet P and thereby in a shape such that prevents a fall-off. The hook portion 372 opens in the circulation direction when the elevator endless belt 36 circulates in a counterclockwise direction when viewed from the front. Accordingly, as is shown in FIG. 2, a sheet P that is fed in the intermediate tray main body 32 while one of the sheet receiving members 37 is positioned on the front surface side (right) of the intermediate tray main body 32 is received by the sheet receiving member 37 while the opening of the hook portion 372 faces upward.

Herein, the first sheet receiving member 37A and the second sheet receiving member 37B are attached to the endless belt 36 so as to form a state where the former is positioned in the vicinity of the driving roller 352 on the back surface side (left) of the intermediate tray main body 32, and the latter is positioned in the vicinity of the top driven roller 353*a* on the back surface side of the intermediate tray main body 32. This is a state where the first sheet receiving member 37A and the second sheet receiving member 37B are present at the home positions.

Hence, when the elevator endless belt 36 circulates in a counterclockwise direction by assuming that a state where the first sheet receiving member 37A and the second sheet receiving member 37B are present at the home positions is the starting point, the lower first sheet receiving member 37A is able to move immediately toward the main surface of the intermediate tray main body 32. When the elevator endless belt 36 circulates in a clockwise direction, the upper second sheet receiving member 37B is able to move immediately toward the main surface of the intermediate tray main body 32.

As has been described, because a state where both the first sheet receiving member 37A and the second sheet receiving member 37B are positioned on the back surface side of the intermediate tray main body 32 is defined as the home positions, the sheet receiving members 37 will not interfere with reception of a sheet P on the intermediate tray main body 32. In addition, because either one of the first sheet receiving member 37A and the second sheet receiving member 37B present at the upper or lower position is able to move toward the main surface of the intermediate tray main body 32 quickly depending on the size of a sheet P, it is possible to bring the sheet receiving members 37 immediately in a condition to receive a sheet P fed from the image forming apparatus 19 for the next job depending on the size of the sheet P.

A stapler 38 that applies staple processing on a pile of sheets P1 is provided at a position opposing the bottom end portion of the intermediate tray main body 32. The stapler 38 includes an arm to receive a pile of sheets P1 and applies staple processing on the edge portion of the pile of sheets, P1, while the pile of sheets, P1, is supported on the arm.

In this embodiment, as is shown in FIG. 3, the driving roller 352 and the top driven roller 353*a* are disposed within a virtual plane in parallel with and in close proximity to the inclined sheet stacking surface (main surface) of the intermediate tray main body 32. In addition, a distance L1 from the outer periphery of the driving roller 352 to the outer periphery of the top driven roller 353*a* is set to be equal to a sheet length L2 of a sheet P of the largest size (herein, A3 size) that can be processed by the processing unit 20. It should be noted that the distance L1 may be slightly shorter than the sheet length L2. Meanwhile, a distance over which the endless belt 36 passes on the main surface side from an attachment position of the first sheet receiving member 37A to the endless belt 36 to an attachment position of the second sheet receiving member 37B to the endless belt 36 is set longer than the sheet length L2.

When the distance L1 is made longer, even a state where the first sheet receiving member 37A or the second sheet receiving member 37B is present on the main surface of the intermediate tray main body 32 is defined as the home position, it is possible to prevent them from interfering with reception of a sheet P on the intermediate tray main body 32. However, when configured in this manner, it is impossible to make the processing unit 20 compact. On the contrary, according to the configuration of this embodiment, it is possible to make the processing unit 20 more compact while preventing the sheet receiving members 37 from interfering with reception of a sheet P, which can in turn make the post-processing device 10 more compact.

In this embodiment, the bottom driven roller 353*b* and the intermediate driven roller 353*c* are provided on the back surface side of the intermediate tray main body 32. According to this configuration, the elevator endless belt 36 has a belt length on the back surface side (on the second surface side) of the intermediate tray main body 32 that is longer than a belt length on the main surface side (on the first surface side). Meanwhile, the first sheet receiving member 37A and the second sheet receiving member 37B are attached onto the elevator endless belt 36 at an almost equal interval. Hence, because the elevator endless belt 36 has an offset length on the back surface side with respect to the main surface side, the first sheet receiving member 37A and the second sheet receiving member 37B are naturally positioned on the back surface side of the intermediate tray main body 32.

The detour tray 40 includes a detour tray main body 42, a cover plate 43, a branching guide 44, a hitting member 45, a vale roller pair 46, a second switching guide 47, and a third switching guide 48.

The detour tray main body 42 is provided across a space between a pair of the second frame main body 41 in a state to oppose the intermediate tray main body 32, so that the detour tray 40 defines the post-processing space V1 with the intermediate tray main body 32 while the posture thereof is set to the closing posture S1 (FIG. 1B).

The cover plate 43 is provided across a space between a pair of the second frame plates 41 so as to oppose the right surface side of the detour tray main body 42.

The branching guide 44 guides a sheet P from the transportation path R3 headed for processing tray that is provided at a position slightly above the top end of the cover plate 43 to the post-processing space V1 in the staple tray 30 or an evacuation space V2 in the detour tray 40.

The branching guide 44 is provided between the transportation path R5 headed for staple tray and the transportation path R6 headed for detour tray and forces a sheet P fed from the transportation path R3 headed for processing tray to be headed for the post-processing space V1 or headed for the evacuation space V2. In FIG. 3, a state where the branching guide 44 is tilted to the right to introduce a sheet P into the post-processing space V1 is indicated by a solid line and a state where the branching guide 44 is tilted to the left to introduce a sheet P into the evacuation space V2 is indicated by a chain double-dashed line.

The hitting member 45 is provided in the vicinity of the top end position of the cover plate 43, and hits a sheet P from the inlet side transportation path R1 toward the branching guide 44 for the sheet P to pass along the branching guide 44.

The valve roller pair 46 temporarily withholds a sheet P fed into the evacuation space V2 from the inlet transportation path R1 on one hand, and on the other hand, it transports the sheet P downward when driven.

The second switching guide 47 is provided at a position directly below the valve roller pair 46, and switches the transportation destination of a sheet P introduced into the detour tray 40 between the post-processing space V1 in the staple tray 30 and the transportation path R7 headed for center folding unit.

The third switching guide 48 is tilted to the left as is indicated by a solid line in FIG. 3 when a sheet P of a large size presses (for example, A3 size) is introduced into the post-processing space V1 so as to press the sheet P of the large size. Meanwhile, when a sheet paper P of a small size (for example, A4 size) is introduced into the post-processing space V1 via the evacuation space V2, the third switching guide 48 is tilted to the right as is indicated by a chain double-dashed line in FIG. 3.

The length of the detour tray main body 42 is set shorter so that the bottom end portion thereof is positioned almost at the center portion of the intermediate tray main body 32 in the top-bottom direction. On the contrary, the dimension of the cover plate 43 is set long so that the bottom end portion thereof is present at a position slightly above the coupling shaft 33. According to this configuration, a sheet P sent downward from the evacuation space V2 by the driving of the valve roller pair 46 is guided by the bottom portion of the cover plate 43 and directed to the post-processing space V1 or the transportation path R7 headed for center folding unit in a reliable manner.

As is shown in FIG. 2, a receiving roller pair 131 that receives a sheet P from the sheet receiving opening 13 is provided at the upstream end of the inlet side transportation path R1, and a releasing roller pair 132 that releases a sheet P downstream is provided at the downstream end thereof. A sheet P released by the releasing roller pair 132 is released toward either the transportation path R2 headed for sub-tray or the transportation path R3 headed for processing tray depending on the posture of the switching guide 18 currently set.

An introduction roller pair 133 is provided at the downstream end of the transportation path R3 headed for processing tray so as to face the top portion of the detour tray main body 42. The introduction roller pair 133 introduces a sheet P from the inlet side transportation path R1 to the top portion of the processing unit 20.

The length of the detour tray main body 42 is set in such a manner that the top edge portion thereof is present at a position almost directly below the introduction roller pair 133 via the branching guide 44 and the bottom edge portion thereof is positioned at almost the center of the intermediate tray main body 32 in the top-bottom direction. Meanwhile, the dimension and the shape of the cover plate 43 are set so that the top edge portion thereof is at a level almost as high as the top edge portion of the detour tray main body 42 and the bottom edge portion thereof is positioned below the bottom edge portion of the detour tray main body 42 and allowed to introduce a sheet P onto the intermediate tray main body 32.

The evacuation space V2 into which a sheet P that has been detoured is temporarily evacuated is defined between the detour tray main body 42 and the cover plate 43 above the valve roller pair 46. The transportation path R7 headed for center folding unit is formed on the one surface side of the cover plate 43 at a position below the valve roller pair 46.

Figures 6A, 6B, 6C:
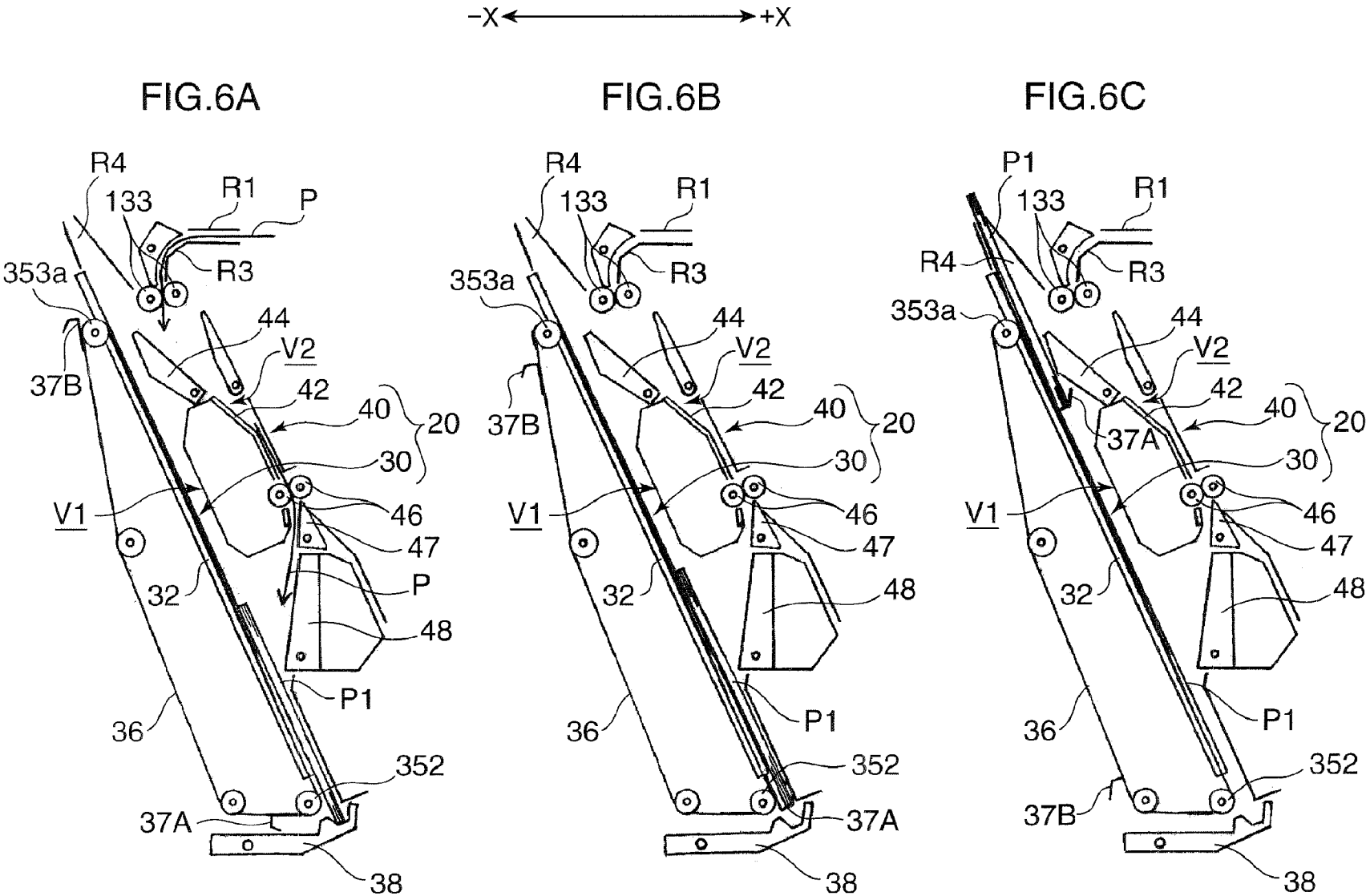
FIGS. 6A through 6C are explanatory views used to describe operations of sheet pressing members and an elevator mechanism performed on a pile of sheets of a small size on the staple tray.
Figures 7A, 7B, 7C:
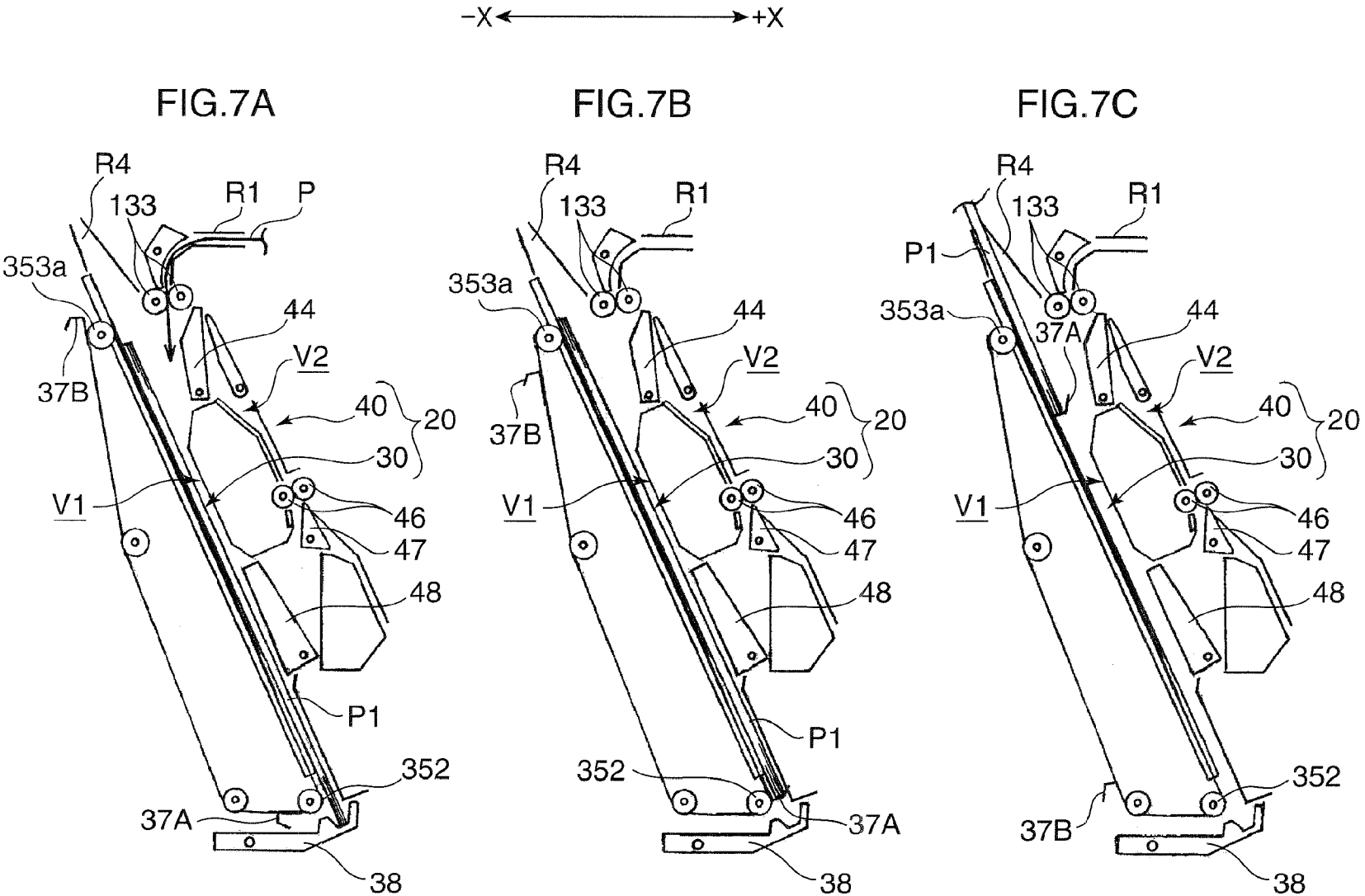
FIGS. 7A through 7C are explanatory views used to describe operations of the sheet pressing members and the elevator mechanism performed on a pile of sheets of a large size on the staple tray.

FIGS. 6A through 6C and FIGS. 7A through 7C are explanatory views to describe actions of the sheet receiving members 37 on a pile of sheets, P1, formed on the intermediate tray main body 32 of the staple tray 30. FIGS. 6A through 6C show a case where a sheet P is of a small size (A4 size in this embodiment), and FIGS. 7A through 7C show a case where a sheet P is of a large size (A3 size in this embodiment). Indications of directions using a capital X in these drawings are the same as in FIG. 2 (−X: leftward, +X: rightward).

FIGS. 6A and 7A show a state where sheets P fed successively from the image forming apparatus 19 are received by the corresponding sheet receiving member 37 and a pile of sheets, P1, is being formed on the intermediate tray main body 32. FIGS. 6B and 7B show a state where staple processing is being applied on the pile of sheets, P1, formed on the intermediate tray main body 32. FIGS. 6C and 7C show a state where the pile of sheets, P1, after the completion of the staple processing is being discharged to the outside.

Firstly, in a case where a sheet P is of a small size, as is shown in FIG. 6A, the branching guide 44 is tilted to the left. In this instance, the first sheet receiving member 37A and the second sheet receiving member 37B are set at the so-called home positions, that is, the former is positioned in the vicinity of the driving roller 352 on the back surface side and the latter is positioned in the vicinity of the top driven roller 353*a* on the back surface side.

In this state, a sheet P from the image forming apparatus 19 is introduced into the processing unit 20 via the inlet side transportation path R1, the transportation path R3 headed for processing tray, and the introduction roller pair 133. The sheet P introduced into the processing unit 20 is carried in toward the detour tray 40 by the branching guide 44 and fed onto the intermediate main body 32 by passing through the detour tray main body 42 and the valve roller pair 46 to be supported on the arm of the stapler 38.

When the feeding of sheets P for one job into the processing unit 20 from the image forming apparatus 19 is completed, as is shown in FIG. 6A, a pile of sheets, P1, made up of a specific number of sheets P is formed on the arm of the stapler 38. In this state, the staple processing by the stapler 38 is applied on the tip end side (bottom end side) of the pile of sheets, P1.

After the staple processing is applied on the pile of sheets, P1, the elevator endless belt 36 is driven to circulate in a counterclockwise direction. As is shown in FIG. 6B, the pile of sheets, P1, that has been received by the arm of the stapler 38 is now being received by the first sheet receiving member 37A as the first sheet receiving member 37A comes around toward the main surface of the intermediate tray main body 32. As the elevator endless belt 36 continues to circulate in a counterclockwise direction, as is shown in FIG. 6C, the pile of sheets, P1, supported on the first sheet receiving member 37A is discharged toward the main tray 14 (FIG. 2) via the transportation path R4 headed for main tray.

In this instance, the second sheet receiving member 37B moves down on the back surface side of the intermediate tray main body 32 in association with the circulation of the elevator endless belt 36 and is headed toward the lower home position. Hence, in order to receive sheets P for the next job, it is sufficient to circulate the elevator endless belt 36 slightly for the second sheet receiving member 37B that is now present at the lower home position to come around toward the main surface of the intermediate tray main body 32. The processing efficiency of the post-processing device 10 can be therefore enhanced.

Subsequently, in a case where a sheet P is of a large size, as is shown in FIG. 7A, the branching guide 44 is tilted to the right and the third branching guide 48 is tilted to the left.

In this state, a sheet P from the image forming apparatus 19 is introduced into the processing unit 20 via the inlet side transportation path R1, the transportation path R3 headed for processing tray, and the introduction roller pair 133. The sheet P introduced into the processing unit 20 is carried in toward the staple tray 30 by the branching guide 44 and moves down on the intermediate tray main body 32 to be received by the arm of the stapler 38.

When the feeding of sheets P for one job into the processing unit 20 from the image forming apparatus 19 is completed, as is shown in FIG. 7A, a pile of sheets, P1, made up of a specific number of sheets P and supported on the arm of the stapler 38 is formed on the intermediate tray main body 32. In this state, staple processing is applied on the bottom end portion of the pile of sheets, P1.

After the staple processing is applied on the pile of sheets, P1, the elevator endless belt 36 is driven to circulate in a counterclockwise direction. As is shown in FIG. 7B, the pile of sheets, P1, that has been received by the arm of the stapler 38 is now being received by the first sheet receiving member 37A as the first sheet receiving member 37A comes around toward the main surface of the intermediate tray main body 32. As the elevator endless belt 36 continues to circulate in a counterclockwise direction, as is shown in FIG. 7C, the pile of sheets, P1, supported on the sheet receiving member 37 is discharged toward the main tray 14 via the transportation path R4 headed for main tray.

As has been described in detail, the post-processing device 10 according to the first embodiment is provided with the intermediate tray main body 32 that receives sheets P fed successively from the image forming apparatus 19 and forms a pile of sheets, P1, in a stacked state, and the elevator endless belt 36 that circulates between the top driven roller 353*a* and the driving roller 352 provided, respectively, at top and bottom of the intermediate tray main body 32 with the intermediate tray main body 32 in between. The elevator endless belt 36 is provided with the sheet receiving members 37 that support the pile of sheets, P1, on the intermediate tray main body 32.

The first sheet receiving member 37A and the second sheet receiving member 37B are provided as the sheet receiving members 37. The first sheet receiving member 37A and the second sheet receiving member 37B are attached to the endless belt 36 so as to form a state where the former is positioned in the vicinity of the driving roller 352 and on the back surface side of the intermediate tray main body 32 and the latter is positioned in the vicinity of the top driven roller 353*a* and on the back surface side of the intermediate tray main body 32.

Accordingly, a pile of sheets, P1, is formed as sheets P are received by the first sheet receiving member 37A, and the pile of sheets, P1, is continuously moved down to the lowest level as the elevator endless belt 36 is driven to circulate. In this state, staple processing is applied on the pile of sheets, P1, by the stapler 38. Thereafter, by inversely driving the elevator endless belt 36, the pile of sheets, P1, after the completion of the staple processing is moved up along the intermediate tray main body 32 to be discharged to the outside. In this instance, because the second sheet receiving member 37B is in a state where it has moved down on the back surface side of the intermediate tray main body 32 and is positioned in the vicinity of the driving roller 352, when a sheet P for the next job is fed from the image forming apparatus 19, it becomes ready to receive the sheet P for the next job by merely moving a short distance. It is thus possible to enhance the processing efficiency of the post-processing device 10.

When sheets P are received and post-processing is applied on a pile of sheets, P1, the first sheet receiving member 37A and the second sheet receiving member 37B each are positioned on the back surface side of the intermediate tray main body 32. This configuration eliminates the occurrence of an inconvenience that the sheet receiving members 37 are positioned on the main surface side of the intermediate tray main body 32 and push the top portion of the pile of sheets, P1, upward. It is thus possible to apply post-processing (staple processing) without disturbing an aligned state of the pile of sheets, P1.

Accordingly, there is no need to extend the length of the intermediate tray main body 32 (a distance between the driving roller 352 and the top driven roller 353*a*) in order to prevent interference with a pile of sheets, P1. It is thus possible to make the post-processing device 10 more compact, which can in turn suppress an increase of the device costs of the post-processing device 10.

Modifications of the first embodiment will now be described.

Figure 8:
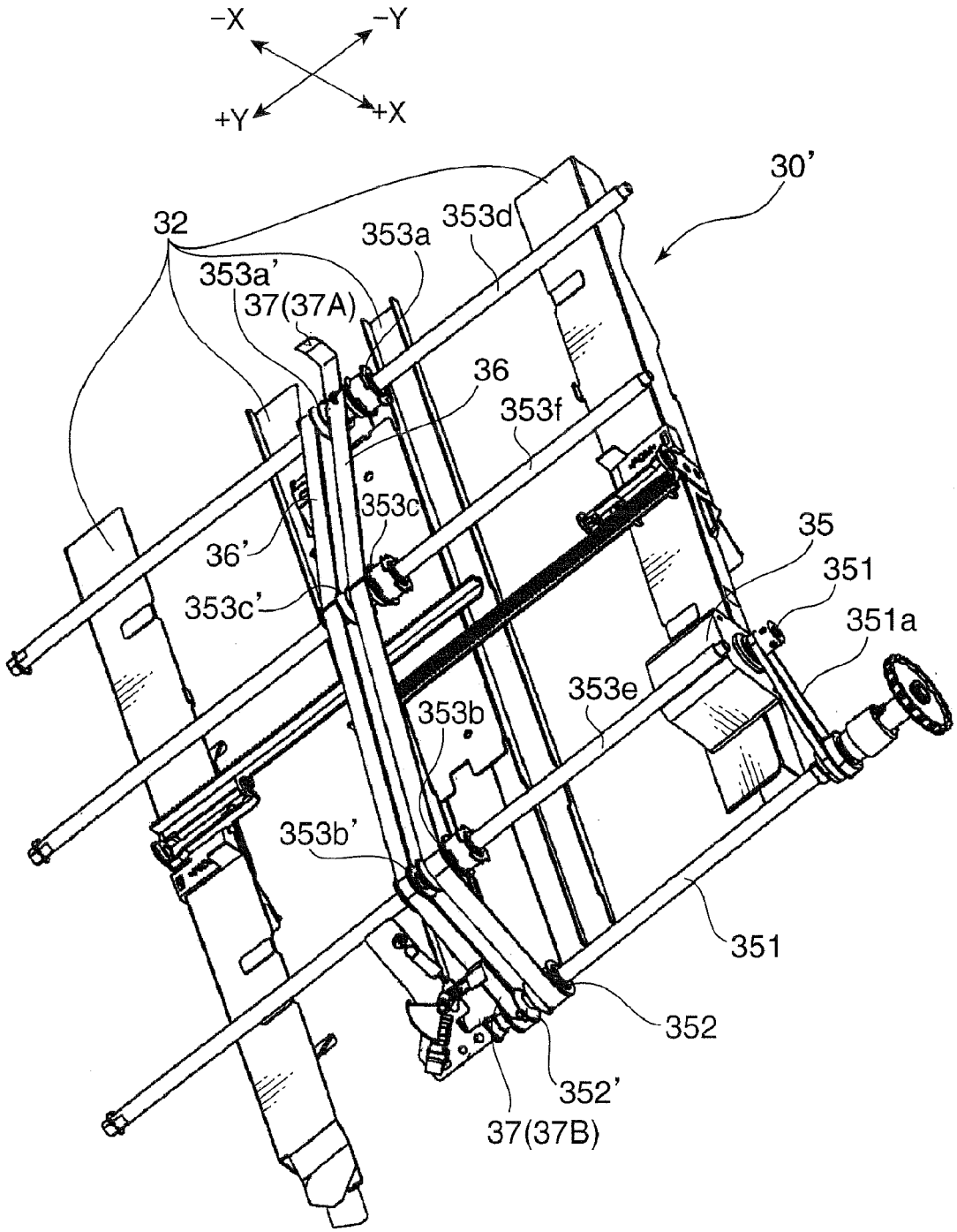
FIG. 8 is a perspective view showing a second example of the staple tray of the first embodiment and it is a perspective view of the staple tray when viewed from the back surface side.

(1) FIG. 8 is a perspective view of a staple tray 30' in the post-processing device 10 as a second example when the staple tray 30' is viewed from the back surface side. Indications of directions using capitals X and Y in FIG. 8 are the same as in FIG. 5 (X indicates the right-left direction (−X: leftward, +X: rightward), Y indicates the front-back direction (−Y: frontward, +Y: backward)).

The staple tray 30' adopts two elevator endless belts (the elevator endless belt 36 same as the one used in the embodiment above and a second elevator endless belt 36' provided adjacently behind and in parallel with the elevator endless belt 36).

The second elevator endless belt 36' is stretched over a second driving roller 352' that is coaxial with and outwardly fit to the driving shaft 351 to be integrally rotatable, a second top driven roller 353*a*' that is coaxial with and axially supported on the top shaft 353*d* to be relatively rotatable, a second bottom driven roller 353*b*' that is coaxial with and axially supported on the bottom shaft 353*e* to be relatively rotatable, and a second intermediate driven roller 353*c*' that is coaxial with and axially supported on the intermediate shaft 353*f* to be relatively rotatable.

The elevator endless belt 36 is provided with the single first sheet receiving member 37A, while the second elevator endless belt 36' is provided with the second sheet receiving member 37B that is the same as the first sheet receiving member 37A.

The home positions of the first sheet receiving member 37A and the second sheet receiving member 37B are defined as a state shown in FIG. 8. At the home positions, the first sheet receiving member 37A and the second sheet receiving member 37B are on the back surface side of the intermediate tray main body 32 and positioned in the vicinity of the top driven roller 353*a* and in the vicinity of the second driving roller 352', respectively. In other words, the positional relation between the first sheet receiving member 37A and the second sheet receiving member 37B is the same as the position relation in the embodiment described above, and a difference is that these members are attached to the two endless belts 36 and 36' in a distributed manner. The action and effect are the same as those achieved in the embodiment described above.

Figure 9:
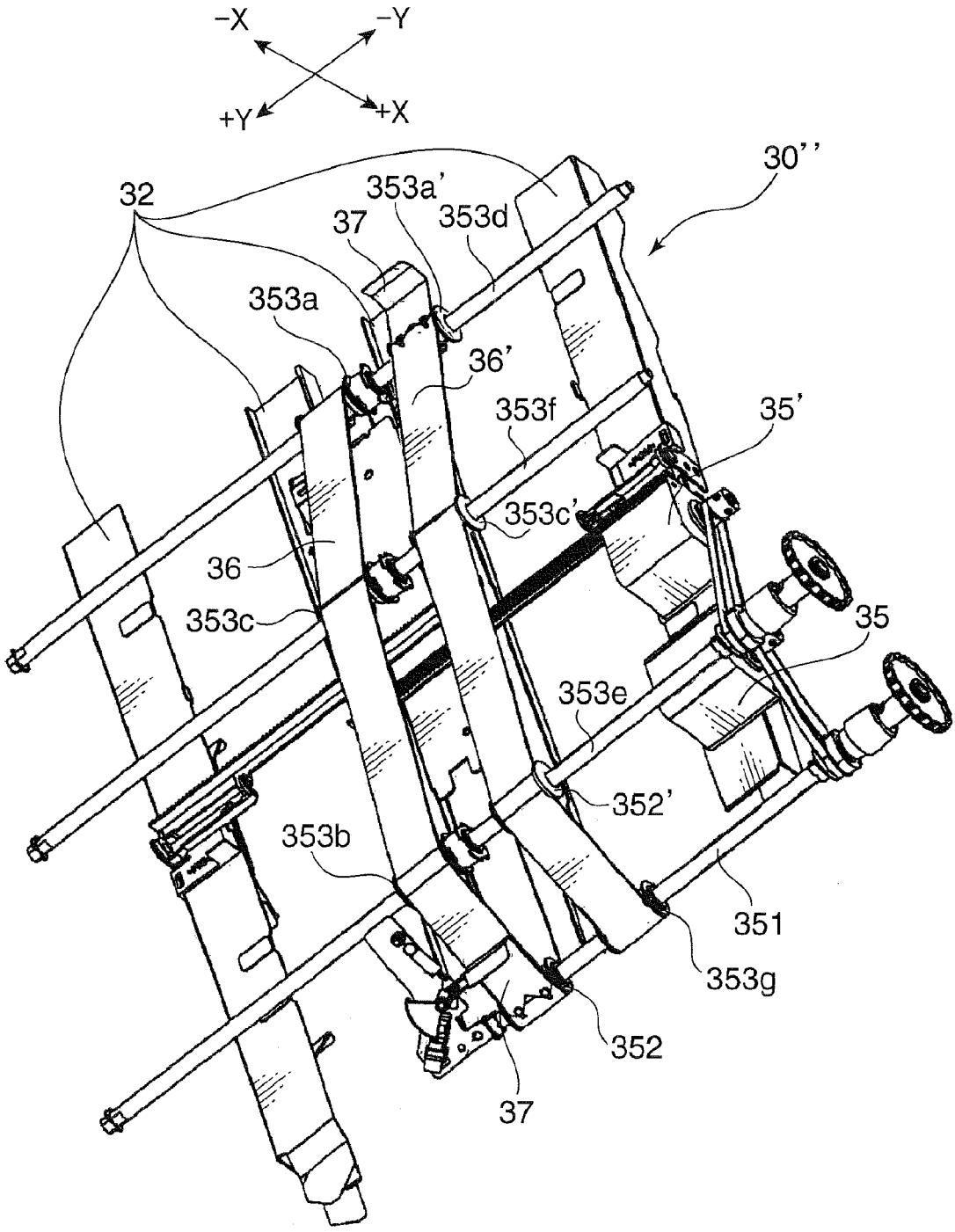
FIG. 9 is a perspective view showing a third example of the staple tray of the first embodiment and it is a perspective view of the staple tray when viewed from the back surface side.

(2) FIG. 9 is a perspective view of a staple tray 30" in the post-processing device 10 as a third example when the staple tray 30" is viewed from the back surface side. The staple tray 30" is a further modification of the staple tray 30' of the second example, and it is provided with a second belt motor 35' for driving the bottom shaft 353*e* to rotate about the shaft center. Accordingly, this example is different from the second example in that the second elevator endless belt 36' circulates independently from the elevator endless belt 36.

In the third example, a second driving roller 352' that integrally rotates with the bottom shaft 353*e* corresponds to the bottom driven roller 353*b* in the second example and a lowermost driven roller 353*g* that rotates relatively with respect to the driving shaft 351 corresponds to the second driving roller 352' in the second example. The second elevator endless belt 36' is stretched over the second driving roller 352', the second intermediate driven roller 353*c*', the second bottom driven roller 353*b*', and the lowermost driven roller 353*g*, and in this state, it is circulated by the driving of the second belt motor 35' independently from the elevator endless belt 36.

According to the staple tray 30" of the third example, the positions of the respective sheet receiving members 37A and 37B provided, respectively, to the two elevator endless belts 36 and 36' can be set independently from each other. This enhances the degree of freedom in supporting sheets P. It is thus possible to make these members ready for sheets P of various sizes in the shortest time, which makes it possible to apply post-processing more efficiently.

(3) In the embodiment above, it is configured in such a manner that a sheet P of a large size (for example, a sheet P of A3 size) is directly introduced into the post-processing space V1, while a sheet P of a small size (for example, a sheet P of A4 size) is introduced into the post-processing space V1 by letting it pass through the detour tray 40 once. Instead of this configuration, it may be configured in such a manner that sheets P of various sizes are directly introduced into the post-processing space V1 without forcing them to be headed for the detour tray 40.

(4) In the embodiment above, the sheet receiving members 37 may be used for press processing to align a pile of sheets, P1, by pressing the top edge portion thereof. In this case, the second sheet receiving member 37B is moved to the top edge portion of a pile of sheets, P1, by circulating the elevator endless belt 36 in a clockwise direction while the pile of sheets, P1, is supported on the stapler 38 for the staple processing (see FIGS. 6B and 7B), so that the top edge portion of the pile of sheets, P1, is pressed by the hook portion 372 of the second sheet receiving member 37B. In this state, the alignment processing is carried out, and the staple processing is applied on the pile of sheets, P1, after the completion of the alignment processing. In this manner, it is possible to align a pile of sheets, P1, in a more reliable manner.

Second Embodiment

Figure 10:
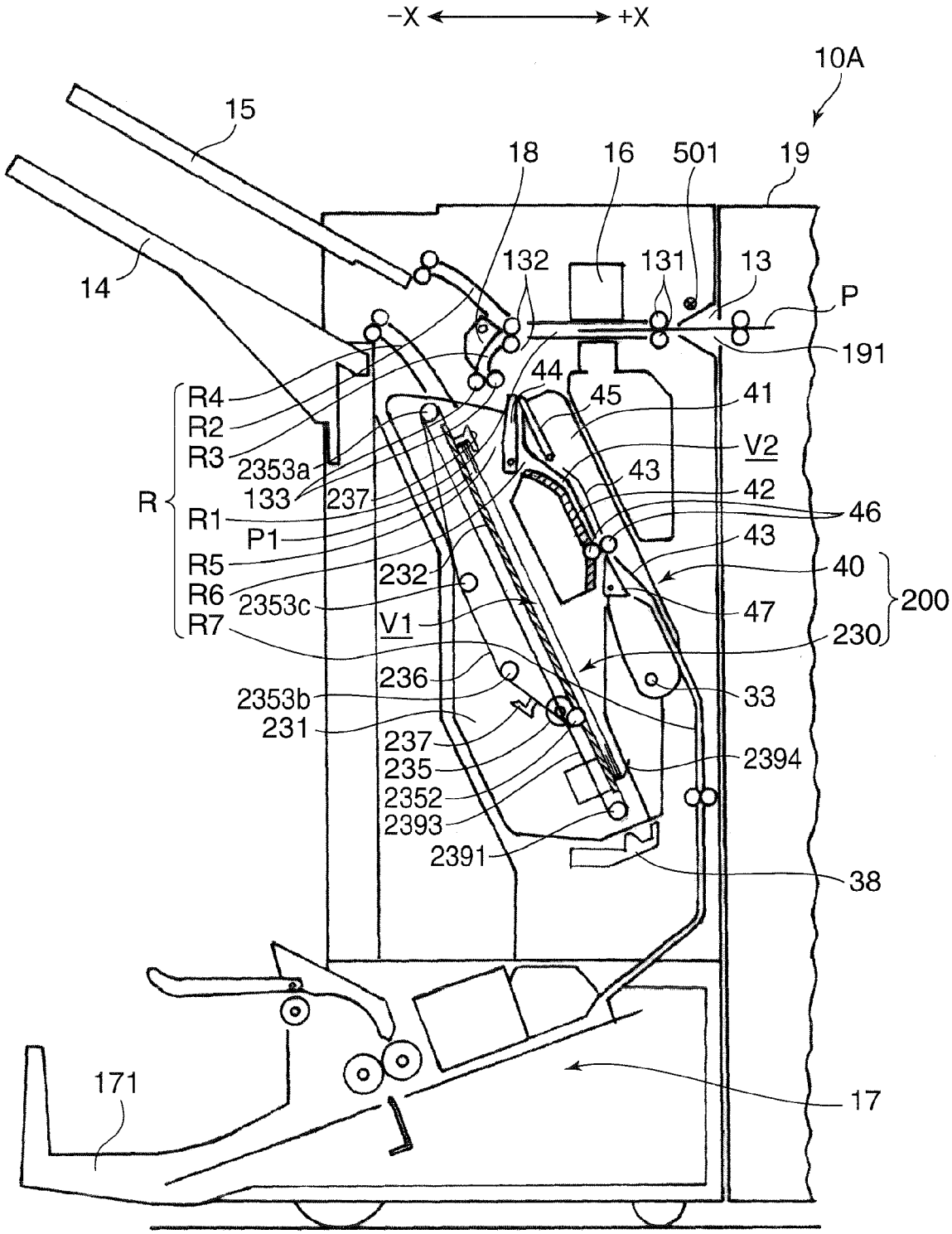
FIG. 10 is an explanatory view of a post-processing device according to a second embodiment when viewed in cross section from the front.

A second embodiment of the invention will now be described. The second embodiment will describe a case where the invention is applied to an endless belt for sheet alignment processing. FIG. 10 is an explanatory view showing the inner structure of a post-processing device 10A according to the second embodiment when viewed in cross section from the front. Indications of directions using a capital X in FIG. 10 are the same as in FIG. 1 (−X: leftward, +X: rightward). Like components are labeled with like reference numerals with respect to FIG. 2 and descriptions thereof are omitted or simplified.

As in the first embodiment, the post-processing device 10A is annexed to the image forming apparatus 19 (apparatus main body), and it receives a sheet after the completion of the image forming processing and applies specific post-processing (sheet processing) on this sheet or a pile of sheets made up of stacked sheets. The outward structure is the same as shown in FIG. 1A through FIG. 1C above.

The post-processing device 10A includes a processing unit 200 that temporarily stores a specific number of sheets P fed therein from the image forming apparatus 19, aligns the sheets, and applies staple processing using bonding staples on a pile of sheets P1 stacked thereon. The processing unit 200 includes a staple tray 230 provided diagonally, and a detour tray 40 additionally provided to go along the diagonal surface of the staple tray 230 on the right side in a rotatable manner with respect to the staple tray 230. Besides the foregoing, as in the first embodiment, the post-processing device 10A has the center folding unit 17, the sheet transportation path R (the inlet side transportation path R1, the transportation path R2 headed for sub-tray, the transportation path R3 headed for processing unit, the transportation path R4 headed for main tray, the transportation path R5 headed for staple tray, the transportation path R6 headed for detour tray, and the transportation path R7 headed for center folding unit).

Figure 11:
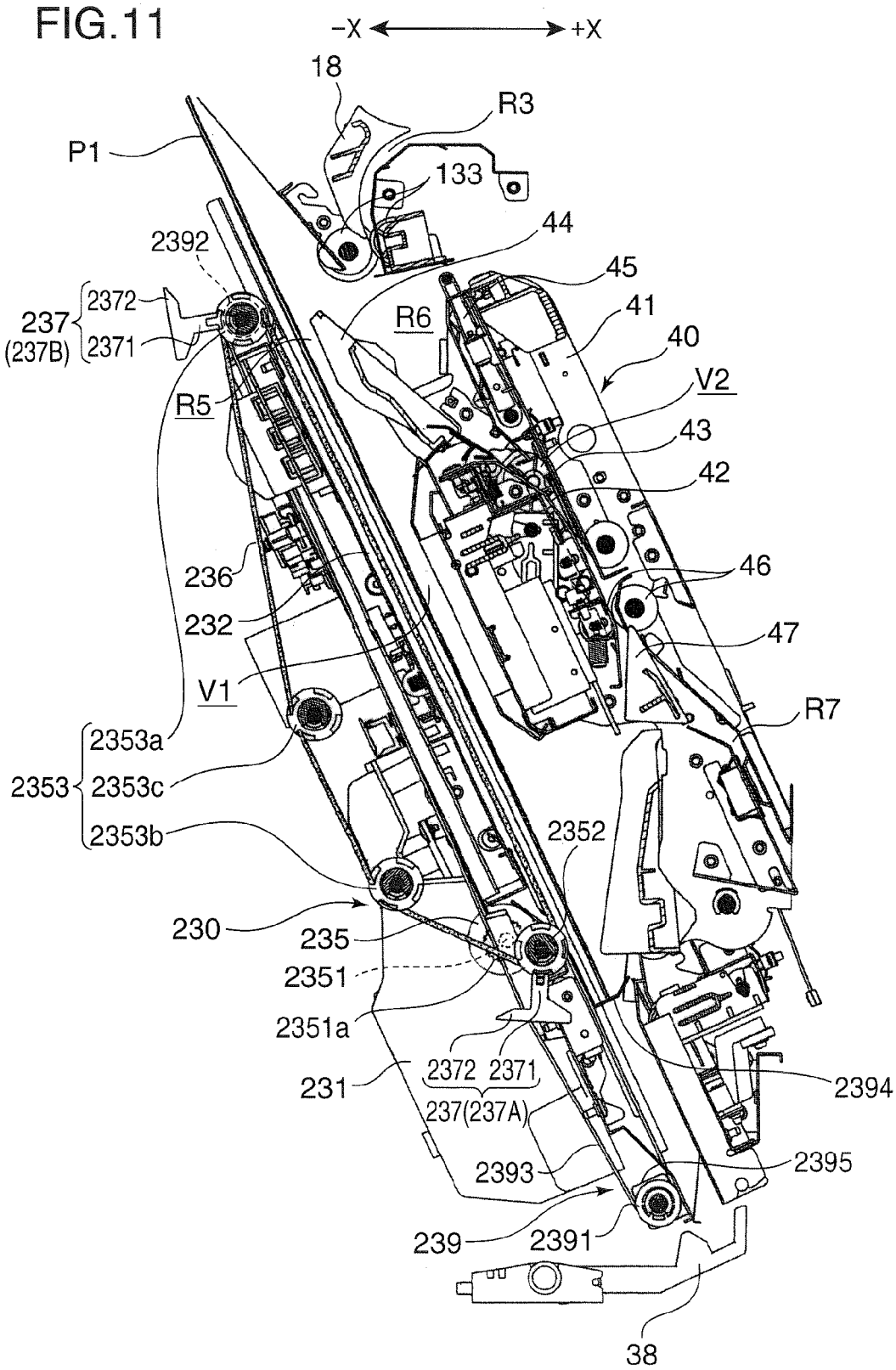
FIG. 11 is an enlarged view of a part of a processing unit of FIG. 10.
Figure 12:
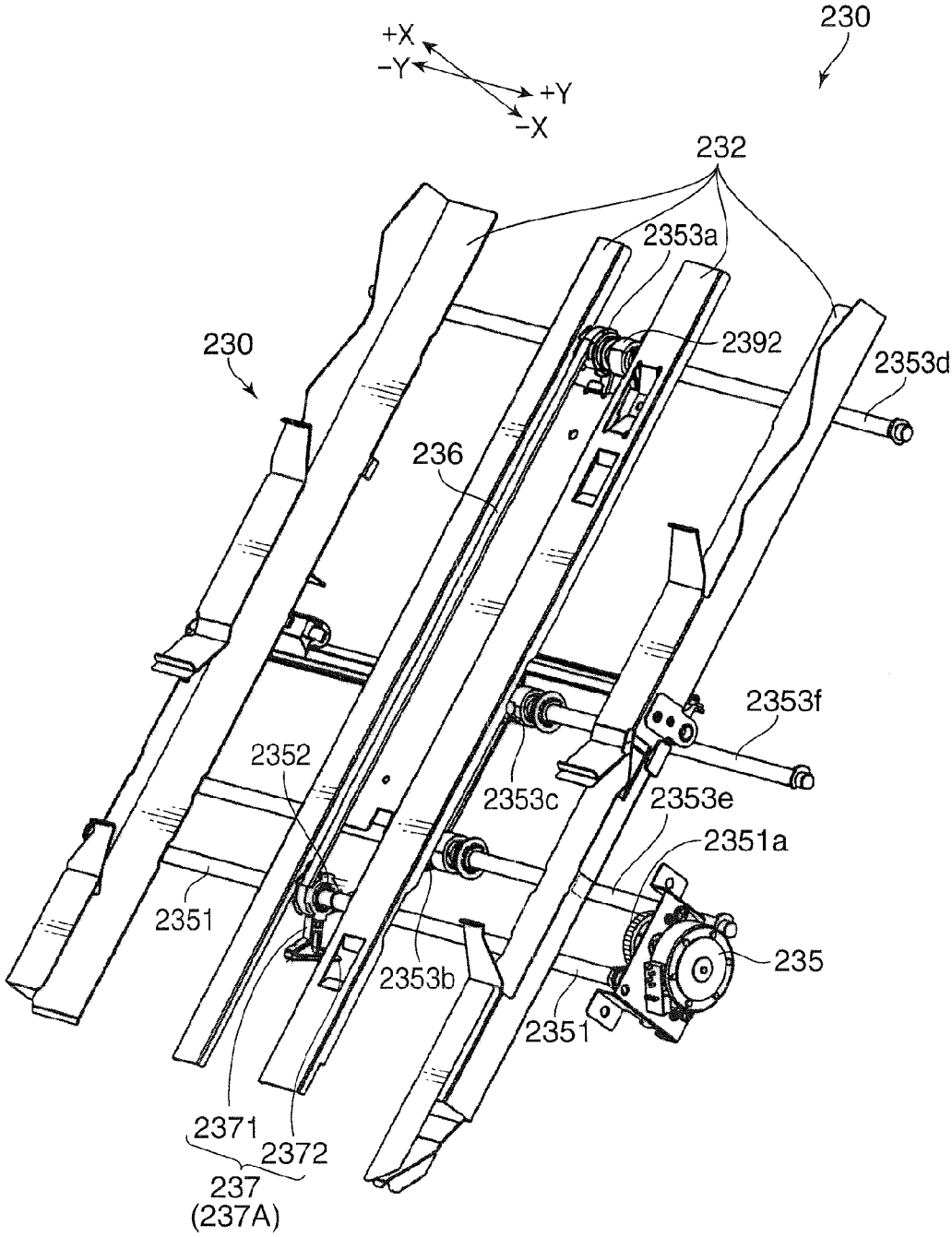
FIG. 12 is a perspective view showing a first example of a staple tray of the second embodiment and it is a view of the staple tray when viewed from the front surface side.
Figure 13:
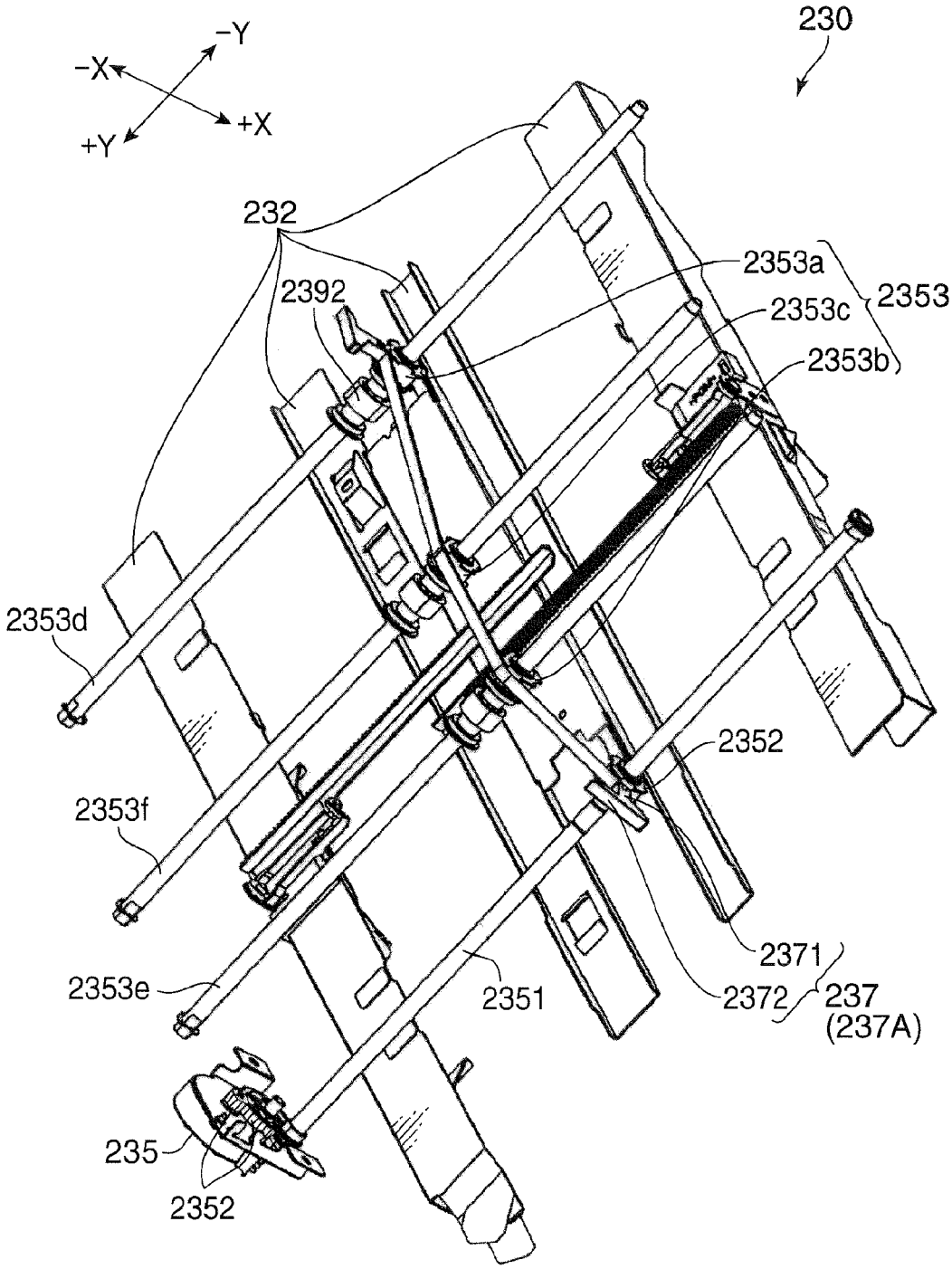
FIG. 13 is a perspective view of the staple tray shown in FIG. 12 when viewed from the back surface side.

Hereinafter, the major portion of the processing unit 200 will be described on the basis of FIG. 11 through FIG. 13. FIG. 11 is an enlarged view of the processing unit 200 shown in FIG. 10. FIG. 12 and FIG. 13 are perspective views showing a first example of the staple tray 230. FIG. 12 is a view of the staple tray 230 when viewed from the main surface side. FIG. 13 is a view of the staple tray 230 when viewed from the back surface side (the surface on the side opposite to the sheet stacking surface). Indications of directions using capitals X and Y in FIG. 11 through FIG. 13 are the same as in FIG. 1 (X indicates the right-left direction (−X: leftward, +X: rightward) Y indicates the front-back direction (−Y: frontward, +Y: backward)).

An intermediate tray main body 232 (processing tray) provided to the staple tray 230 forms a pile of sheets, P1, in which plural sheets P are stacked. The right side of the intermediate tray main body 232 shown in FIG. 11 is the main surface (first surface) and the side of this main surface serves as the sheet stacking surface to receive sheets P successively fed from the image forming apparatus 19.

On the back surface (a second surface on the side opposite to the first surface) of the intermediate tray main body 232, a belt motor 235 is disposed on a first frame plate 231 in a state where the driving shaft 2351 thereof is aligned in the front-back direction. The driving rotation of the driving shaft 2351 of the belt motor 235 is transmitted to a driving roller 2352 (first roller) provided at a specific position at the bottom portion of the intermediate tray main body 232 via a gear mechanism 2351*a*.

Plural driven rollers 2353 each in a state where the driven shaft is provided across a space between a pair of first frame plates 231 are provided at the top end position of the intermediate tray main body 232 and at appropriate points on the back surface side of the intermediate tray main body 232. An alignment endless belt 236 (second endless belt) is stretched over the driving roller 2352 and the respective driven rollers 2353.

In this embodiment, a top driven roller 2353*a* (second roller) provided correspondingly to the top portion side of the intermediate tray main body 232, a bottom driven roller 2353*b* provided at the bottom portion of the intermediate tray main body 232 on the back surface side at a position slightly above the driving roller 2352, and an intermediate driven roller 2353*c* provided at an intermediate position between the top and bottom driven rollers 2353*a* and 2353*b* are included as the driven rollers 2353.

The top driven roller 2353*a* is axially supported so as to be relatively rotatable about the top shaft 2353*d* provided across a space between a pair of the first frame plates 231. In addition, the bottom driven roller 2353*b* is axially supported to be relatively rotatable about the bottom shaft 2353*e*. Further, the intermediate driven roller 2353*c* is axially supported to be relatively rotatable about the intermediate shaft 2353*f*.

The alignment endless belt 236 is stretched over the driving roller 2352 and the driven rollers 2353 (plural rollers), and circulates by way of the main surface (first surface) side and the back surface (second surface) side of the intermediate tray main body 232. Herein, the driving roller 2352 reverses the circulation path of the alignment endless belt 236 from the main surface side to the back surface side, and the top driven roller 2353*a* reverses the circulation path of the alignment endless belt 236 from the back surface side to the main surface side (in a case where the circulation direction of the alignment endless belt 236 is counterclockwise).

The alignment endless belt 236 is provided with a pair of sheet pressing members 237. The sheet pressing members 237 each press the top edge portion of a pile of sheets, P1, with oscillation while a sheet receiving member 2394 described below supports the bottom edge portion of the pile of sheets, P1, in the post-processing space V1, and thereby apply the alignment processing on the pile of sheets P1. This embodiment describes a case where two members, a first sheet pressing member 237A and a second sheet pressing member 237B (a first pressing member and a second pressing member; collectively referred to simply as the sheet pressing members 237), are attached to the alignment endless belt 236.

The sheet pressing members 237 each include a leg portion 2371 provided to erect from the alignment endless belt 236, and a fall-off preventing piece 2372 provided to protrude from the end portion of the leg portion 2371. The fall-off preventing piece 2372 is provided to protrude in the circulation direction in a case where the alignment endless belt 236 circulates in a clockwise direction.

In a state where the sheet pressing members 237 are positioned on the intermediate tray main body 232, the sheet pressing members 237 protrude from the intermediate tray main body 232. According to this configuration, the top end portion of a pile of sheets, P1, received by the sheet receiving member 2394 described below is pressed by the leg portion 2371 of the corresponding sheet pressing member 237 and stopped so as not to fall off by the fall-off preventing piece 2372.

Herein, the first sheet pressing member 237A and the second sheet pressing member 237B are attached to the endless belt 236 so as to form a state where the former is positioned in the vicinity of the driving roller 2352 and on the back surface side (left) of the intermediate tray main body 232 and the latter is positioned in the vicinity of the top driven roller 2353*a* and on the back surface side of the intermediate tray main body 232. This is a state where the first sheet pressing member 237A and the second sheet pressing member 237B are present at the home positions.

Accordingly, when the alignment endless belt 236 starts to circulate in a counterclockwise direction by assuming that a state where the respective sheet pressing members 237A and 237B are present at the home positions is the starting point, the lower first sheet pressing member 237A is able to move immediately onto the intermediate tray main body 232. In addition, when the alignment endless belt 236 circulates in a clockwise direction, the upper second sheet pressing member 237B is able to move immediately onto the intermediate tray main body 232.

As has been described, either one of the first sheet pressing member 237A and the second sheet pressing member 237B present at the upper or lower position is able to move quickly toward the main surface of the intermediate tray main body 232 depending on the size of sheets P. To be more concrete, in a case where a sheet P is of a small size, the first sheet pressing member 237A positioned on the lower side is able to move toward the main surface of the intermediate tray main body 232 and in a case where a sheet P is of a large size, the second sheet pressing member 237B positioned on the upper side is able to move toward the main surface of the intermediate tray main body 232 by a slight amount of circulation. It is therefore possible to bring the sheet pressing members 237 in a condition to apply the alignment processing immediately on a sheet P for the next job fed from the image forming apparatus 19.

The first sheet pressing member 237A and the second sheet pressing member 237B each apply the alignment processing by abutting on the rear end of a pile of sheets, P1, in the sheet carry-in direction on the intermediate tray main body 232 (the top end in a case where a pile of sheets, P1, is on the intermediate tray main body 232). When the alignment processing is applied, the first sheet pressing member 237A and the second sheet pressing member 237B are oscillated in the top-bottom direction. In this instance, the tip end of a pile of sheets, P1, in the sheet carry-in direction is supported on the sheet receiving members 2394.

In this embodiment, the driving roller 2352 and the top driven roller 2353*a* are disposed within a virtual plane in parallel with and in proximity to the inclined sheet stacking surface (main surface) of the intermediate tray main body 232. By making an interval between the driving roller 2352 and the top driven roller 2353*a* almost equal to a difference between a sheet length of a sheet of the largest processable size (for example, A3 size) and a sheet length of a sheet of the smallest processable size (for example, B5 size), the processing unit 200 can be made more compact. Also, by allowing the first sheet pressing member 237A and the second sheet pressing member 237B to be positioned on the back surface side of the intermediate tray main body 232 simultaneously at the home positions, a roller interval that has been made smaller as above is allowed.

In this embodiment, the intermediate driven roller 2353*c* and the bottom driven roller 2353*b* are provided on the back surface side of the intermediate tray main body 232. When configured in this manner, the alignment endless belt 236 has a belt length on the back surface side (on the second surface side) of the intermediate tray main body 232 that is longer than a belt length on the main surface side (on the first surface side). Meanwhile, the first sheet pressing member 237A and the second sheet pressing member 237B are attached to the alignment endless belt 236 almost at an equal interval. Accordingly, because the alignment endless belt 236 has an offset length on the back surface side with respect to the main surface side, the first sheet pressing member 237A and the second sheet pressing member 237B are naturally positioned in the back surface of the intermediate tray main body 232.

A stapler 38 that applies staple processing on a pile of sheets, P1, is provided at a position opposing the bottom end portion of the intermediate tray main body 232. In order to discharge a pile of sheets, P1, after the completion of the staple processing to the outside, an elevator mechanism 239 as shown in FIG. 11 is provided in this embodiment.

The elevator mechanism 239 includes an elevator driving roller 2391 provided to the intermediate tray main body 232 at the bottom end on the back surface side thereof, an elevator driven roller 2392 coaxial with the top driven roller 2353*a* and axially supported by the driven shaft thereof at the top end portion of the intermediate tray main body 232, an elevator endless belt 2393 (first endless belt) stretched over these elevator driving roller 2391 and elevator driven roller 2392, a sheet receiving member 2394 (supporting members) provided to the elevator endless belt 2393 so as to support a pile of sheets, P1, and an elevator driving motor 2395 that drives the elevation driving roller 2391 to rotate.

When the alignment processing of a pile of sheets, P1, by the oscillations of the sheet pressing members 237 is completed, staple processing is applied on a pile of sheets, P1, being received by the stapler 38. Sheets P after the completion of the staple processing are moved up by the circulation of the elevator endless belt 2393 in a counterclockwise direction by the driving of the elevator driving motor 2395 via the sheet receiving members 2394, and then discharged to the outside.

In this instance, the first sheet pressing member 237A is moved up simultaneously by the circulation of the alignment endless belt 236 in a counterclockwise direction, and stopped when it reaches the home position (the position of the second sheet pressing member 237B in FIG. 11). In this instance, the second sheet pressing member 237B is also at the home position. Because the first sheet pressing member 237A and the second sheet pressing member 237B present at the home positions are both positioned on the back surface side of the intermediate tray main body 232, the pile of sheets, P1, being moved up will not interfere with the sheet pressing members 237 and is therefore discharged smoothly.

Figures 14A, 14B:
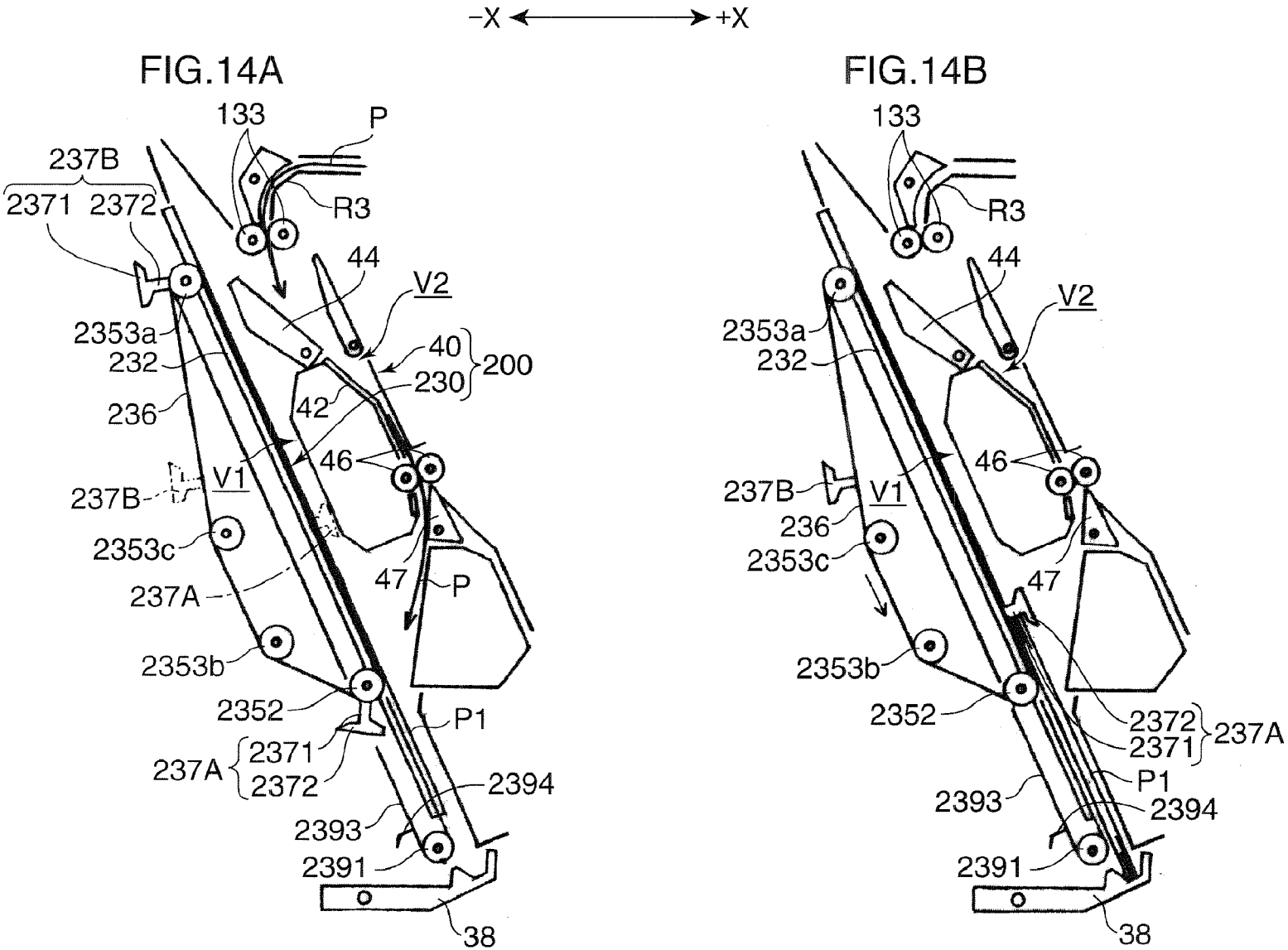
FIG. 14A through 14D are explanatory views used to describe operations of sheet pressing members and an elevator mechanism performed on a pile of sheets of a small size on the staple tray.
Figures 14C, 14D:
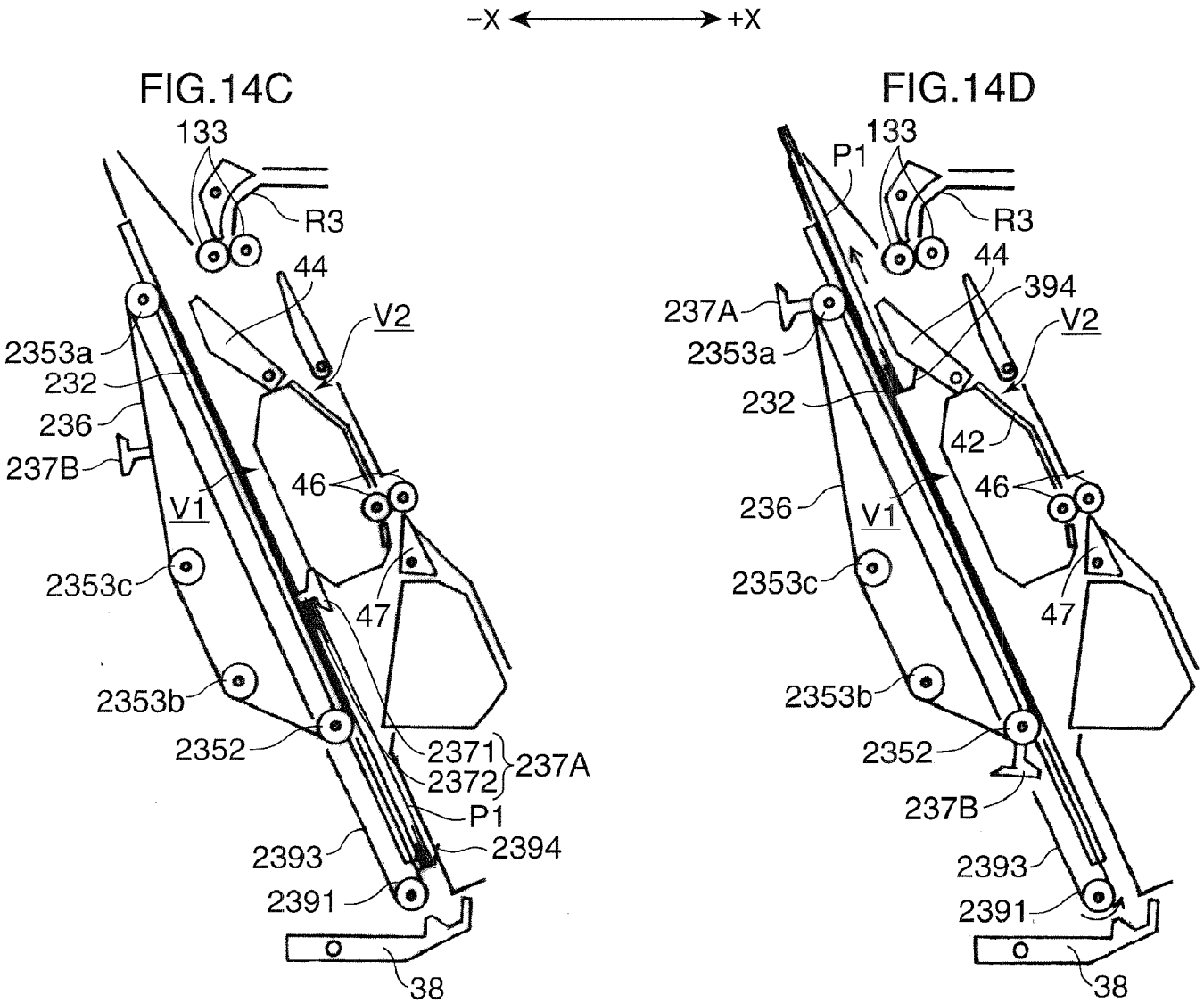
Figures 15A, 15B, 15C:
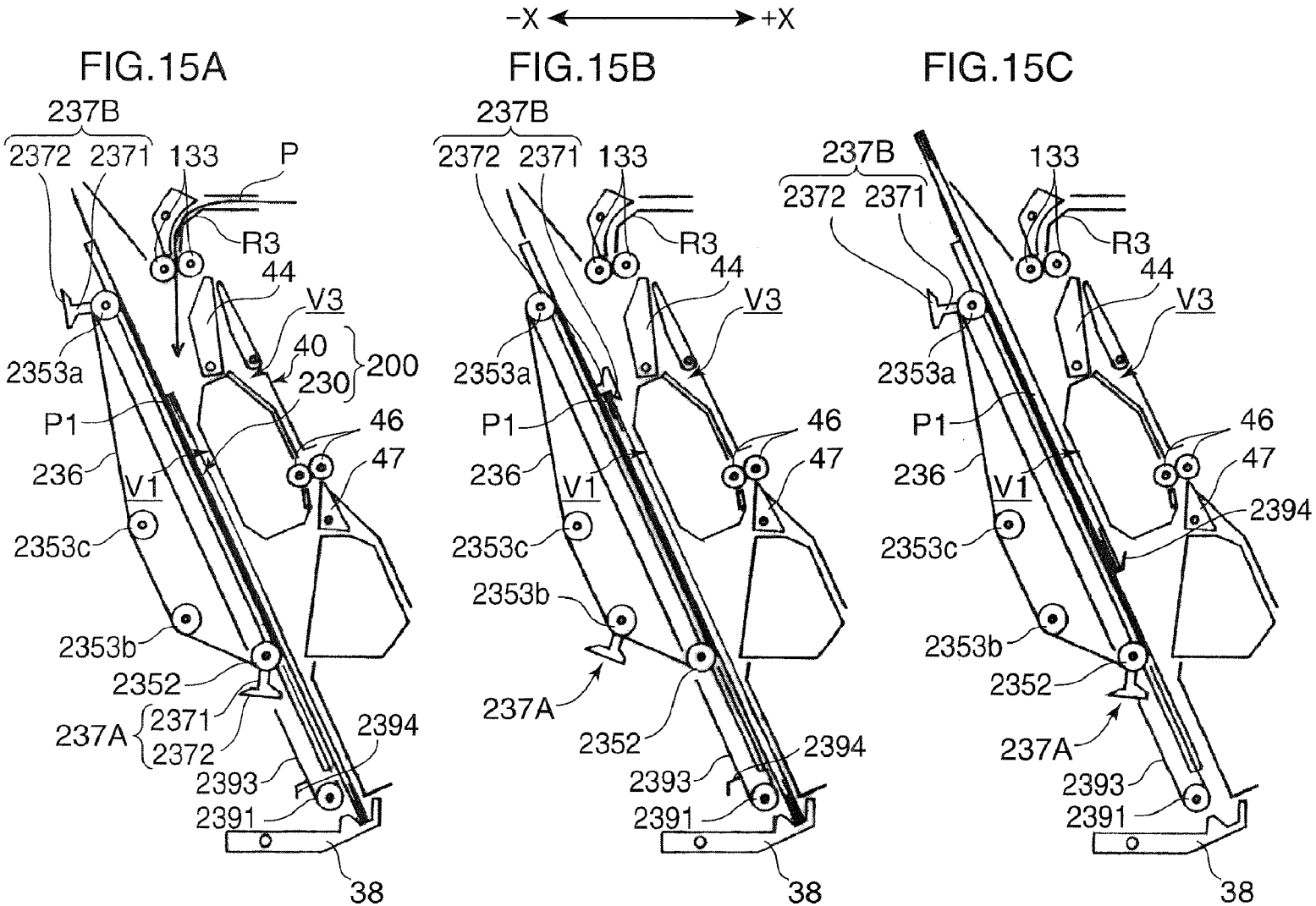
FIGS. 15A through 15C are explanatory views used to describe operations of the sheet pressing members and the elevator mechanism performed on a pile of sheets of a large size on the staple tray.

FIGS. 14A through 14D and FIGS. 15A through 15C are explanatory views used to describe operations of the sheet pressing members 237 and the elevator mechanism 239 performed on a pile of sheets, P1, formed on the intermediate tray main body 232 of the staple tray 230. FIGS. 14A through 14D show a case where a sheet P is of a small size (A4 size in this embodiment) and FIGS. 15A through 15C show a case where a sheet P is of a large size (A3 size in this embodiment). Indications of directions using a capital X in these drawings are the same as in FIG. 11 (−X: leftward, +X: rightward).

Firstly, a case where a sheet P is of a small size will be described. As is shown in FIG. 14A, the so-called home positions are defined as a state where the first sheet pressing member 237A is positioned in the vicinity of the driving roller 2352 on the back surface side and the second sheet pressing member 237B is positioned in the vicinity of the top driven roller 2353*a* on the back surface side. The sheet receiving member 2394 is positioned in the vicinity of the elevator driving roller 2391 on the back surface side.

In a case where a sheet P is of a small size, the branching guide 44 is tilted to the left. Further, the first sheet pressing member 237A is moved from the home position (indicated by a solid line in FIG. 14A) to a position indicated by a chain double-dashed line in FIG. 14A by the circulation of the elevator endless belt 236 in a counterclockwise direction. This position is almost at the intermediate position of the intermediate tray main body 232 in the top-bottom direction, and it is a height position at which the first sheet pressing member 237A does not interfere with the top end of a pile of sheets, P1, received by the stapler 38. It should be noted that the second sheet pressing member 237B moves down on the back surface of the intermediate tray main body 232 in association with the movement as above (indicated by a chain double-dashed line of FIG. 14A).

In this state, a sheet P from the image forming apparatus 19 is introduced into the processing unit 200 via the inlet side transportation path R1, the transportation path R3 headed for processing unit, and the introduction roller pair 133. The sheet P introduced into the processing unit 200 is carried in toward the detour tray 40 by the branching guide 44 and fed onto the intermediate tray main body 232 by passing through the detour tray main body 42 and the valve roller pair 46 to be received by the sheet receiving member 2394.

When the feeding of sheets P for one job into the processing unit 200 from the image forming apparatus 19 is completed, a pile of sheets, P1, made up of a specific number of sheets P and supported on the supporting arm of the stapler 38 is formed on the intermediate tray main body 232.

In this state, the alignment endless belt 236 is driven to circulate by a specific distance in a clockwise direction. Accordingly, as is shown in FIG. 14B, the first sheet pressing member 237A is in a state where the leg portion 2371 presses the top end portion of the pile of sheets, P1, and the fall-out preventing piece 2372 caps on the top end portion of the pile of sheets, P1.

The alignment endless belt 236 is continuously circulated forward and backward slightly, which causes the first sheet pressing member 237A to oscillate. The alignment processing to align the end portion of the pile of sheets, P1 supported on the sheet receiving members 2394 is thus carried out. When the alignment processing is completed, the stapler 38 applies the staple processing on the tip end portion (the bottom portion) of the pile of sheets, P1, supported on the supporting arm of the stapler 38.

When the staple processing on the pile of sheets, P1, is completed, as is shown in FIG. 14C, the sheet receiving member 2394 positioned at the bottom end portion of the intermediate tray main body 232 on the back surface side is moved toward the main surface of the intermediate tray main body 232 by the circulation of the elevator endless belt 2393 in a counterclockwise direction. Accordingly, the bottom end of the pile of sheets, P1, that has been supported on the arm of the stapler 38 is now supported on the sheet receiving members 2394. In this instance, the first sheet pressing member 237A being used for the alignment processing by pressing the end portion (top end) of the pile of sheets, P1, is also moved up in synchronization with the movement of the sheet receiving member 2394 by the circulation of the alignment endless belt 236 in a counterclockwise direction.

By the simultaneous movements of the sheet receiving member 2394 and the first sheet pressing member 237A as described above, as is shown in FIG. 14D, the pile of sheets, P1, after the completion of the staple processing is moved up along the intermediate tray main body 232 and discharged toward the main tray 14 (FIG. 2) via the transportation path R4 headed for main tray.

In this instance, the first sheet pressing member 237A that had been pressing the top end portion of the pile of sheets, P1, is moved to the upper home position (on the back surface side of the intermediate tray main body 232 in the vicinity of the top driven roller 2353*a*). In addition, the second sheet pressing member 237B that had been positioned on the upper side is set to the lower home position (on the back surface side of the intermediate tray main body 232 in the vicinity of the driving roller 2352). Hence, the pile of sheets, P1, is discharged smoothly to the outside without being interfered with the first sheet pressing member 237A and the second sheet pressing member 237B.

In a case where a sheet P is of a large size will now be described. In this case, as is shown in FIG. 15A, the branching guide 44 is tilted to the right. Both the first sheet pressing member 237A and the second sheet pressing member 237B are set at the home positions, and are therefore brought into a state where they will not protrude toward the main surface (right surface) of the intermediate tray main body 232. In addition, the position of the sheet receiving member 2394 is set at the lowermost end portion of the intermediate tray main body 232 on the back surface side.

In this state, a sheet P from the image forming apparatus 19 is introduced into the processing unit 200 via the inlet side transportation path R1, the transportation path R3 headed for processing unit, and the introduction roller pair 133. The sheet P introduced into the processing unit 200 is carried in toward the staple tray 230 by the branching guide 44 and moves down on the intermediate tray main body 232 to be received by the stapler 38.

When the feeding of sheets P for one job into the processing unit 200 from the image forming apparatus 19 is completed, as is shown in FIG. 15B, a pile of sheets, P1, made up of a specific number of sheets P and supported on the supporting arm of the stapler 38 is formed on the intermediate tray main body 232.

In this state, the alignment endless belt 236 is driven to circulate in a clockwise direction. Accordingly, the second sheet pressing member 237B is in a state where the leg portion 2371 presses the top end portion of the pile of sheets, P1, and the fall-off preventing piece 2372 caps on the top end portion of the pile of sheets, P1.

Subsequently, the alignment processing to align the end portion of the pile of sheets, P1, supported by the sheet receiving member 2394 is carried out by the oscillation of the second sheet pressing member 237B induced by slightly circulating the alignment endless belt 236 forward and backward. When this alignment processing is completed, the staple processing is applied on the bottom end portion of the pile of sheets, P1, supported on the supporting arm of the stapler 38.

After the staple processing is applied on the pile of sheets, P1, as is shown in FIG. 15C, the pile of sheets, P1, is discharged toward the main tray 14 via the transportation path R4 headed for main tray by the circulation of the elevator endless belt 2393 in a counterclockwise direction.

In this instance, the alignment endless belt 236 is also circulated in synchronization with the circulation of the elevator endless belt 2393. The second sheet pressing member 237B is moved toward the back surface of the intermediate tray main body 232 in the vicinity of the top driven roller 2353*a*. Accordingly, the pile of sheets, P1, is discharged to the outside without being interfered with the second sheet pressing member 237B.

As has been described in detail, the post-processing device 10A according to the second embodiment includes the intermediate tray main body 232 that forms a pile of sheets, P1, the elevator endless belt 2393 that moves the pile of sheets, P1, and the alignment endless belt 236 that enables the alignment processing to be carried out. It is possible to drive these belts 2393 and 236 independently, and the degree of freedom in transportation and alignment processing of the pile of sheets, P1, can be enhanced, which makes it possible to enhance the processing efficiency of the post-processing markedly.

The first sheet pressing members 237A and the second sheet pressing members 237B are attached to the endless belt 236 so as to form a state where the former is positioned in the vicinity of the driving roller 2352 and on the back surface side (left) of the intermediate tray main body 232 and the latter is positioned in the vicinity of the top driven roller 2353*a* and on the back surface side of the intermediate tray main body 232. Hence, by allowing the sheet pressing members 237 to be present at the home positions when a pile of sheets, P1, is transported by the driving of the elevator endless belt 2393, it is possible to avoid interference with the pile of sheets, P1.

Modifications of the second embodiment above will now be described.

Figure 16:
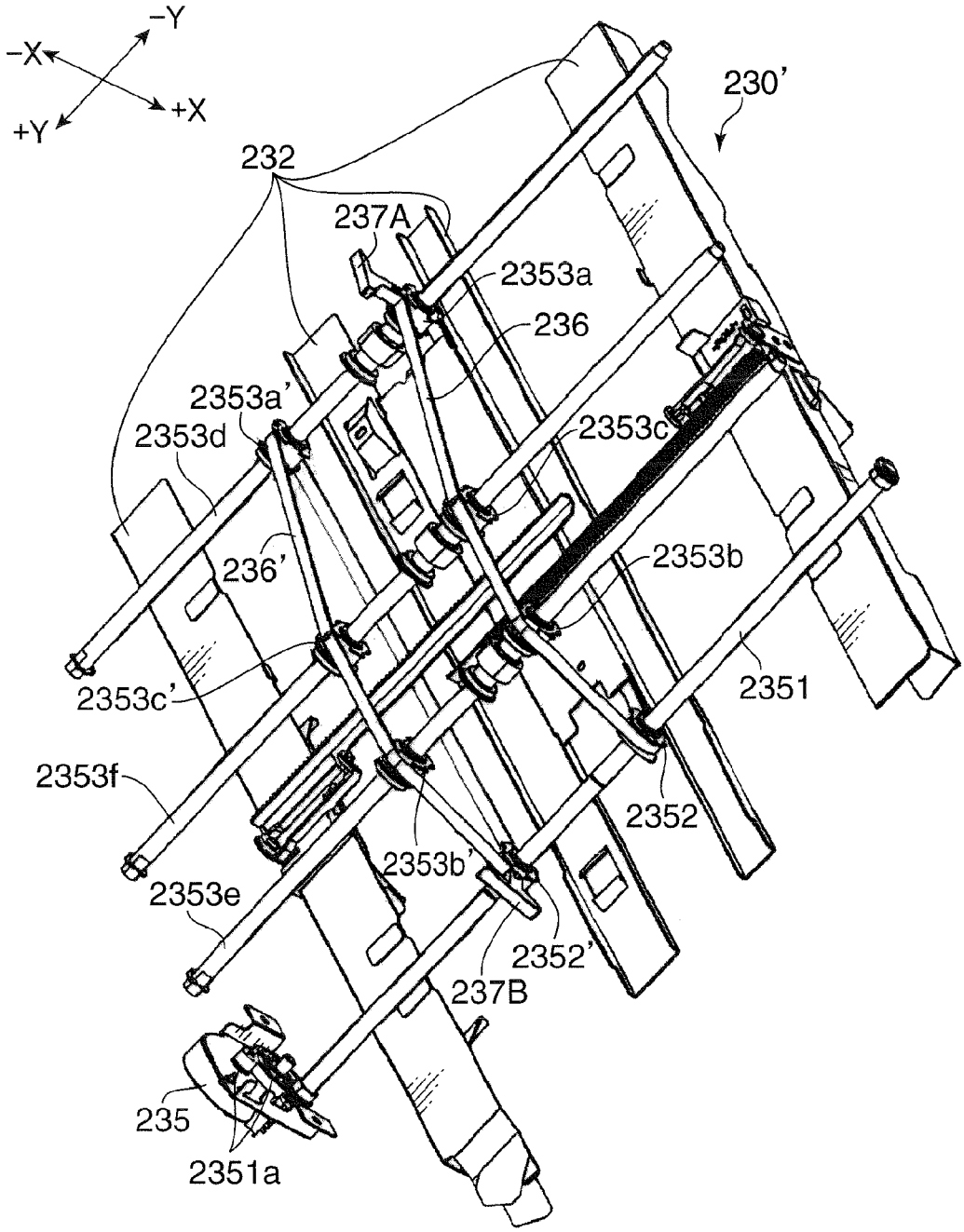
FIG. 16 is a perspective view showing a second example of the staple tray of the second embodiment and it is a perspective view of the staple tray when viewed from the back surface side.

(1) FIG. 16 is a perspective view of a staple tray 230' in the post-processing device 10A as a second example when the staple tray 230' is viewed from the back surface side. Indications of directions using capitals X and Y in FIG. 16 are the same as in FIG. 12 (X indicates the right-left direction (−X: leftward, +X: rightward), Y indicates the front-back direction (−Y: frontward, +Y: backward)).

The staple tray 230' adopts two alignment endless belts (the one same as the alignment endless belt 236 used in the embodiment above and a second alignment endless belt 236' provided adjacently behind and in parallel with the alignment endless belt 236).

The second alignment endless belt 236' is stretched over a second driving roller 2352' that is coaxial with and outwardly fit to the driving shaft 2351 to be integrally rotatable, a second top driven roller 2353*a'* that is coaxial with and axially supported on the top shaft 2353*d* to be relatively rotatable, a second bottom driven roller 2353*b'* that is coaxial with and axially supported on the bottom shaft 2353*e* to be relatively rotatable, and a second intermediate roller 2353*c'* that is coaxial with and axially supported on the intermediate shaft 2353*f* to be relatively rotatable.

The alignment endless belt 236 is provided with the single first sheet pressing member 237A while the second alignment endless belt 236' is provided with the second sheet pressing member 237B same as the first sheet pressing member 237A.

The home positions of the first sheet pressing member 237A and the second sheet pressing member 237B are defined as a state shown in FIG. 16. At the home positions, the first sheet pressing member 237A and the second sheet pressing member 237B are on the back surface side of the intermediate tray main body 232 and positioned, respectively, in the vicinity of the top driven roller 2353*a* and in the vicinity of the second driving roller 2352'. In other words, the positional relation between the first sheet pressing member 237A and the second sheet pressing member 237B is the same as the positional relation in the embodiment shown in FIG. 12, and a difference is that these members are attached to the two alignment endless belts 236 and 236' in a distributed manner. The action and effect are the same as those achieved in the embodiment described above.

Figure 17:
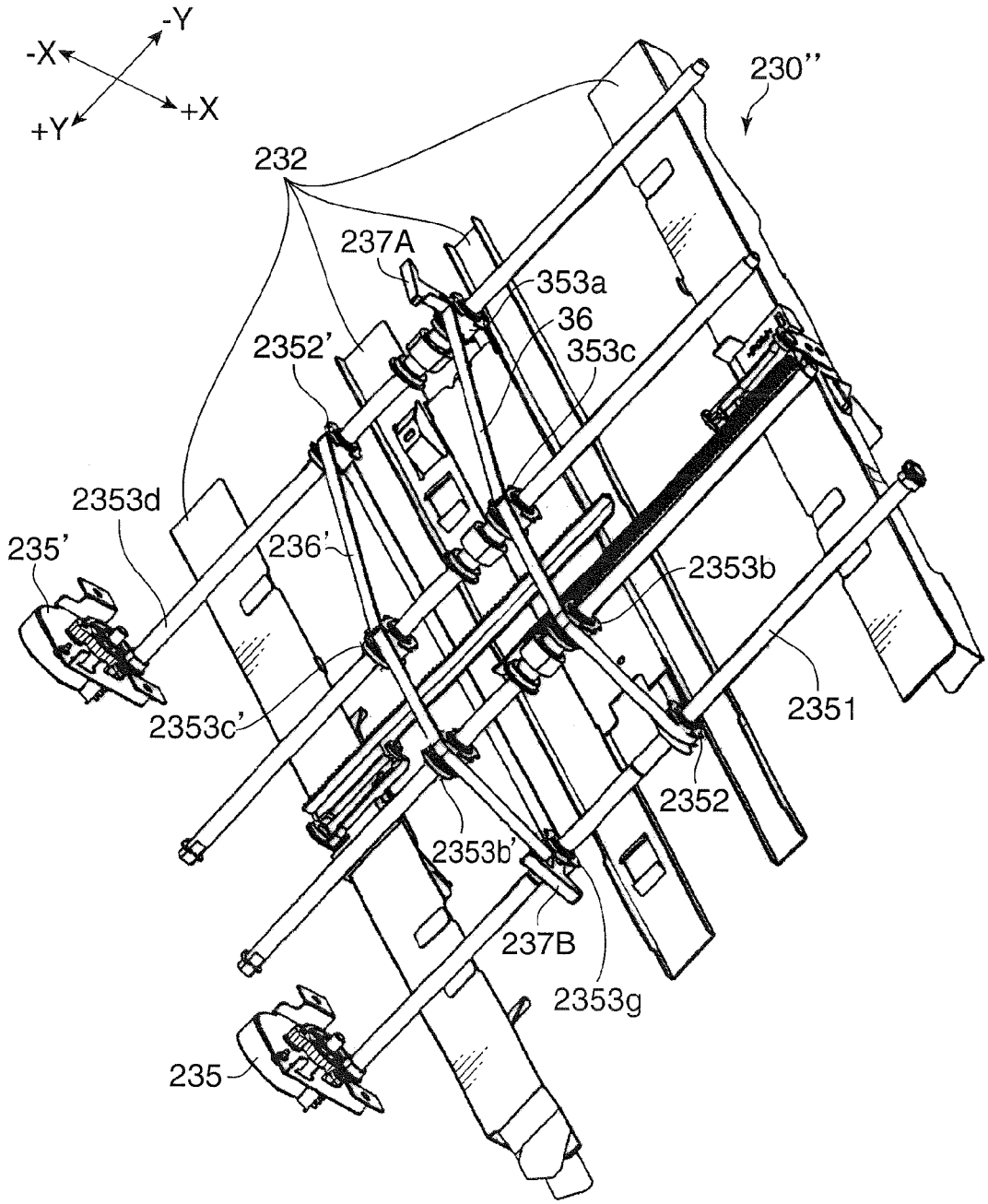
FIG. 17 is a perspective view showing a third example of the staple tray of the second embodiment and it is a perspective view of the staple tray when viewed from the back surface side.

(2) FIG. 17 is a perspective view of a staple tray 230" in the post-processing device 10A as a third example when viewed from the back surface side. The staple tray 230" is a further modification of the staple tray 230' of the second embodiment, and it is provided with a second belt motor 235' that drives the top shaft 2353*d* to rotate about the shaft center. This configuration allows the second alignment belt 236' to circulate independently from the alignment endless belt 236, which is different from the second example.

In the third example, a second driving roller 2352' that rotates integrally with the top shaft 2353*d* corresponds to the top driven roller 2353*a* in the second example, and a lowermost driven roller 2353*g* that rotates relatively with respect to the driving shaft 2351 corresponds to the second driving roller 2352' The second alignment endless belt 236' is stretched over the second driving roller 2352', the second intermediate driven roller 2353*c'*, the second bottom driven roller 2353*b'*, and the lowermost driven roller 2353*g*, and in this state, it is circulated independently from the alignment endless belt 236 by the driving of the second belt motor 235'.

According to the staple tray 230" of the third example, because the positions of the respective sheet pressing members 237A and 237B provided, respectively, to the two alignment endless belts 236 and 236' can be set independently from each other, the degree of freedom in pressing a sheet P can be enhanced. It is thus possible to make these members ready for sheets P of various sizes in the shortest time, which makes it possible to apply post-processing more efficiently.

(3) In the embodiment above, it is configured in such a manner that a sheet P of a large size (for example, a sheet P of A3 size) is directly introduced into the post-processing space V1, while a sheet P of a small size (for example, a sheet P of A4 size) is introduced into the post-processing space V1 by letting it pass through the detour tray 40 once. Instead of this configuration, it may be configured in such a manner that sheets P of various sizes are directly introduced into the post-processing space V1 without forcing them to be headed for the detour tray 40.

(4) In the embodiment above, the sheet pressing members 237 are used only for the processing to press a pile of sheets, P1, and the feeding of a pile of sheets, P1, to the stapler 38 and the discharging of the pile of sheets, P1, after the completion of the post-processing are carried out by the sheet receiving member 2394 for exclusive use. However, the sheet processing member 2394 may be omitted, and instead, it may be configured in such a manner that one of the two sheet pressing members 237 is used for the processing to press a pile of sheets, P1, and the other sheet pressing member 237 is used for the discharge of a pile of sheets, P1. When configured in this manner, omission of the elevator endless belt 2393, the sheet receiving member 2394, and further the elevator driving motor 2395 can contribute to a reduction of the device costs of the post-processing device 10A.

(5) In the embodiment above, the sheet pressing members 237 are provided to the alignment endless belt 236 in pair. However, three or more of them can be provided. When configured in this manner, any one of the sheet pressing members 237 can be immediately positioned on the intermediate tray main body 232 depending on the situation. This configuration therefore contributes to achievement of further fast post-processing.

The specific embodiments described above chiefly include inventions having the following configurations.

A sheet processing device according to one aspect of the invention is a sheet processing device that applies specific processing on a pile of sheets, including: a processing tray that is provided with a first surface to receive sheets successively fed therein and forms the pile of sheets in a stacked state; an endless belt that circulates by way of a first surface side and a second surface side on a side opposite to the first surface of the processing tray; plural rollers over which the endless belt is stretched; and a first abutting member and a second abutting member that are attached to the endless belt and allowed to abut on an end edge portion of the pile of sheets, wherein: the plural rollers include a first roller that reverses a circulation path of the endless belt from the first surface side to the second surface side, and a second roller that is disposed at a specific interval from the first roller and reverses the circulation path from the second surface side to the first surface side; and the first abutting member and the second abutting member are attached to the endless belt so as to form a state where the first abutting member is positioned in the vicinity of the first roller and on the second surface side and the second abutting member is positioned in the vicinity of the second roller and on the second surface side.

According to this configuration, the first abutting member and the second abutting member are allowed to be positioned simultaneously on the second surface side of the processing tray. Accordingly, because interference of sheets on the processing tray with the abutting members can be avoided, not only is it possible to make the processing tray more compact, but it is also possible to prevent an aligned state of a pile of sheets on the processing tray from being disturbed. In addition, because the first abutting member and the second abutting member stand by in the vicinity of the first roller and the second roller, respectively, they are allowed to move toward the first surface of the processing tray quickly when the need arises. The sheet processing efficiency can be therefore enhanced.

In the configuration described above, the first abutting member and the second abutting member can be, respectively, a first supporting member and a second supporting member on which the pile of sheets on the processing tray is supported. According to this configuration, a pile of sheets can be supported and transported efficiently.

In this case, it may be configured in such a manner that the endless belt is provided in a plural form and at least two endless belts are provided in parallel with each other, and that the first supporting member and the second supporting member are provided, one for each endless belt.

According to this configuration, it is possible to move the first supporting member and the second supporting member independently from each other in response to the circulation of the respective endless belts. The degree of freedom in making the respective supporting members ready for a sheet can be thus increased.

In the configuration described above, it is preferable that: the first roller and the second roller are disposed within a plane that is in close proximity to and almost in parallel with the first surface; a distance between the first roller and the second roller is set one of almost equal to and shorter than a sheet length of a sheet of a largest processable size; and a distance over which the endless belt passes on the first surface side from an attachment position of the first supporting member to the endless belt to an attachment position of the second supporting member to the endless belt is set longer than the sheet length.

According to this configuration, the processing tray can be made more compact, which can in turn make the sheet processing device more compact.

In the configuration described above, it is preferable that the circulation path of the endless belt is set longer on the second surface side than on the first surface side, and that the first supporting member and the second supporting member are attached onto the endless belt at an almost equal interval.

In the configuration described above, the first abutting member and the second abutting member can be, respectively, a first pressing member and a second pressing member that align the pile of sheets by pressing a rear end portion thereof in a feeding direction onto the first surface. According to this configuration, it is possible to apply the alignment processing or the like on a pile of sheets efficiently.

In this case, it is preferable that the endless belt is provided in a plural form and at least two endless belts are provided in parallel with each other, and that the first pressing member and the second pressing member are provided, one for each endless belt.

Also, it is preferable that the first roller and the second roller are disposed within a plane that is in close proximity to and almost in parallel with the first surface, and that an interval between the first roller and the second roller is almost equal to a difference between a sheet length of a sheet of a largest processable size and a sheet length of a sheet of a smallest processable size. When configured in this manner, the processing tray can be made more compact, which can in turn make the sheet processing device more compact.

In the configuration described above, it is preferable that the circulation path of the endless belt is set longer on the second surface side than on the first surface side, and that the first pressing member and the second pressing member are attached onto the endless belt at an almost equal interval.

A sheet processing device according to another aspect of the invention is a sheet processing device that applies specific processing on a pile of sheets, including: a processing tray that is provided with a first surface to receive sheets successively fed therein and forms the pile of sheets in a stacked state; a first endless belt that circulates by way of a first surface side and a second surface side on a side opposite to the first surface of the processing tray; a second endless belt that circulates by way of the first surface side and the second surface side on the side opposite to the first surface of the processing tray; plural rollers over which the first endless belt and the second endless belt are stretched; a supporting member that is attached to the first endless belt and supports thereon the pile of sheets on the processing tray; and a first pressing member and a second pressing member that are attached to the second endless belt and align the sheets by pressing a rear end portion thereof in a feeding direction onto the first surface, wherein: the plural rollers include a first roller that reverses a circulation path of the second endless belt from the first surface side to the second surface side, and a second roller that is disposed at a specific interval from the first roller and reverses the circulation path from the second surface side to the first surface side; and the first pressing member and the second pressing member are attached to the second endless belt so as to form a state where the first pressing member is positioned in the vicinity of the first roller and on the second surface side and the second pressing member is positioned in the vicinity of the second roller and on the second surface side.

According to this configuration, not only is it possible to avoid interference of the sheets on the processing tray with the pressing members, but it is also possible to make the processing tray more compact. Also, depending on the size of a sheet, either one of the pressing members can be ready for the sheet quickly by a movement over a distance shorter than a distance over which the other pressing member has to move.

In the configuration described above, it may be configured in such a manner that the second endless belt is provided in a plural form and at least two endless belts are provided in parallel with each other, and the first pressing member and the second pressing member are provided, one for each endless belt.

An image forming apparatus according to still another aspect of the invention includes: an apparatus main body that applies image forming processing on a sheet; and a post-processing device that receives a sheet after completion of the image forming processing from the apparatus main body and applies specific post-processing on a pile of sheets made up of sheets that have been received and stacked. The post-processing device includes: a processing tray that is provided with a first surface to receive sheets successively fed therein and forms the pile of sheets in a stacked state; an endless belt that circulates by way of a first surface side and a second surface side on a side opposite to the first surface of the processing tray; plural rollers over which the endless belt is stretched; and a first abutting member and a second abutting member that are attached to the endless belt and allowed to abut on an end edge portion of the pile of sheets, wherein: the plural rollers include a first roller that reverses a circulation path of the endless belt from the first surface side to the second surface side, and a second roller that is disposed at a specific interval from the first roller and reverses the circulation path from the second surface side to the first surface side; and the first abutting member and the second abutting member are attached to the endless belt so as to form a state where the first abutting member is positioned in the vicinity of the first roller and on the second surface side and the second abutting member is positioned in the vicinity of the second roller and on the second surface side.

In this case, it is possible to shorten the post-processing time while ensuring smooth transportation of a pile of sheets on the processing tray. Accordingly, the invention is applicable to a high-speed machine of an image forming apparatus in a satisfactory manner. It is thus possible to enhance sheet processing efficiency including the image forming apparatus.

This application is based on patent application Nos. 2007-011119 and 2007-013462 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet processing device that applies specific processing on a pile of sheets, comprising:

a processing tray that is provided with a first surface to receive sheets successively fed therein and forms the pile of sheets in a stacked state;

an endless belt that circulates by way of a first surface side and a second surface side on a side opposite to the first surface of the processing tray;

plural rollers over which the endless belt is stretched; and a first abutting member and a second abutting member that are attached to the endless belt and allowed to abut on an end edge portion of the pile of sheets, wherein:

a circulation path of the endless belt is set longer on the second surface side than on the first surface side;

the plural rollers include a first roller that reverses a circulation path of the endless belt from the first surface side to the second surface side, a second roller that is disposed below the first roller with a specific interval from the first roller and reverses the circulation path from the second surface side to the first surface side and a third roller that is disposed below the second surface side; and the first abutting member and the second abutting member are attached to the endless belt so as to form a state where the first abutting member is positioned in the vicinity of the first roller and on the second surface side and the second abutting member is disposed between the second and third rollers and spaced from the second and third rollers.

2. The sheet processing device according to claim 1, wherein:

the first abutting member and the second abutting member are, respectively, a first supporting member and a second supporting member on which the pile of sheets on the processing tray is supported.

3. The sheet processing device according to claim 2, wherein:

the endless belt is provided in a plural form and at least two endless belts are provided in parallel with each other; and the first supporting member and the second supporting member are provided, one for each endless belt.

4. The sheet processing device according to claim 2, wherein:

the first roller and the second roller are disposed within a plane that is in close proximity to and almost in parallel with the first surface;

a distance between the first roller and the second roller is set one of almost equal to and shorter than a sheet length of a sheet of a largest processable size; and a distance over which the endless belt passes on the first surface side from an attachment position of the first supporting member to the endless belt to an attachment position of the second supporting member to the endless belt is set longer than the sheet length.

5. The sheet processing device according to claim 2, wherein:

the circulation path of the endless belt is set longer on the second surface side than on the first surface side; and the first supporting member and the second supporting member are attached onto the endless belt at an almost equal interval.

6. The sheet processing device according to claim 1, wherein:

the first abutting member and the second abutting member are, respectively, a first pressing member and a second pressing member that align the pile of sheets by pressing a rear end portion thereof in a feeding direction onto the first surface.

7. The sheet processing device according to claim 6, wherein:

the endless belt is provided in a plural form and at least two endless belts are provided in parallel with each other; and the first pressing member and the second pressing member are provided, one for each endless belt.

8. The sheet processing device according to claim 6, wherein:

the first roller and the second roller are disposed within a plane that is in close proximity to and almost in parallel with the first surface; and an interval between the first roller and the second roller is almost equal to a difference between a sheet length of a sheet of a largest processable size and a sheet length of a sheet of a smallest processable size.

9. The sheet processing device according to claim 6, wherein:

the circulation path of the endless belt is set longer on the second surface side than on the first surface side; and the first pressing member and the second pressing member are attached onto the endless belt at an almost equal interval.

10. An image forming apparatus, comprising:

an apparatus main body that applies image forming processing on a sheet; and a post-processing device that receives a sheet after completion of the image forming processing from the apparatus main body and applies specific post-processing on a pile of sheets made up of sheets that have been received and stacked, wherein the post-processing device includes:

a processing tray that is provided with a first surface to receive sheets successively fed therein and forms the pile of sheets in a stacked state;

an endless belt that circulates by way of a first surface side and a second surface side on a side opposite to the first surface of the processing tray;

plural rollers over which the endless belt is stretched; and a first abutting member and a second abutting member that are attached to the endless belt and allowed to abut on an end edge portion of the pile of sheets, and wherein:

a circulation path of the endless belt is set longer on the second surface side than on the first surface side;

the plural rollers include a first roller that reverses a circulation path of the endless belt from the first surface side to the second surface side, and a second roller that is disposed below the first roller with a specific interval from the first roller and reverses the circulation path from the second surface side to the first surface side and a third roller that is disposed below the second surface side; and the first abutting member and the second abutting member are attached to the endless belt so as to form a state where the first abutting member is positioned in the vicinity of the first roller and on the second surface side and the second abutting member is disposed between the second and third rollers and spaced from the second and third rollers.

11. The image forming apparatus according to claim 10, wherein:

the first abutting member and the second abutting member are, respectively, a first supporting member and a second supporting member on which the pile of sheets on the processing tray is supported.

12. The image forming apparatus according to claim 10, wherein:

the first abutting member and the second abutting member are, respectively, a first pressing member and a second pressing member that align the pile of sheets by pressing a rear end portion of the pile of sheets in a feeding direction of the sheets onto the first surface.

13. The sheet processing device according to claim 1, wherein the endless belt circulates in a circulation direction, the first and second abutting members having hook portions spaced out from the endless belt and opening in the circulation direction.

14. The image forming apparatus according to claim 10, wherein the endless belt circulates in a circulation direction, the first and second abutting members having hook portions spaced out from the endless belt and opening in the circulation direction.

* * * * *